US012044250B2

(12) United States Patent
Teramoto et al.

(10) Patent No.: US 12,044,250 B2
(45) Date of Patent: Jul. 23, 2024

(54) CENTRIFUGAL BLOWER, AIR-BLOWING APPARATUS, AIR-CONDITIONING APPARATUS, AND REFRIGERATION CYCLE APPARATUS

(71) Applicant: Mitsubishi Electric Corporation, Tokyo (JP)

(72) Inventors: Takuya Teramoto, Tokyo (JP); Ryo Horie, Tokyo (JP); Takahiro Yamatani, Tokyo (JP); Kazuya Michikami, Tokyo (JP); Hiroshi Tsutsumi, Tokyo (JP); Keijiro Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 18/453,491

(22) Filed: Aug. 22, 2023

(65) Prior Publication Data

US 2023/0400036 A1 Dec. 14, 2023

Related U.S. Application Data

(62) Division of application No. 17/899,236, filed on Aug. 30, 2022, now abandoned, which is a division of (Continued)

(30) Foreign Application Priority Data

Oct. 27, 2017 (WO) ..... PCT/JP2017/038960

(51) Int. Cl.
*F04D 29/42* (2006.01)
*F04D 29/44* (2006.01)
*F24F 1/0022* (2019.01)

(52) U.S. Cl.
CPC ..... *F04D 29/4226* (2013.01); *F04D 29/422* (2013.01); *F04D 29/441* (2013.01); *F24F 1/0022* (2013.01)

(58) Field of Classification Search
None
See application file for complete search history.

(56) References Cited

U.S. PATENT DOCUMENTS 3,856,431 A 12/1974 Tucker
5,474,422 A * 12/1995 Sullivan ..... F04D 29/626 415/206

(Continued)

FOREIGN PATENT DOCUMENTS

CN 102317633 A 1/2012
CN 104179728 A 12/2014

(Continued)

OTHER PUBLICATIONS

Office Action dated Jun. 11, 2019 issued in corresponding TW patent application No. 107137947.

(Continued)

*Primary Examiner* — Sabbir Hasan
(74) *Attorney, Agent, or Firm* — Posz Law Group, PLC

(57) ABSTRACT

A centrifugal air blower includes a fan; and a scroll casing. The scroll casing includes: a sidewall covering the fan from an axial direction of a rotation axis, the sidewall having a suction opening for sucking air; a discharge opening; a tongue portion for guiding the airflow to the discharge opening; a peripheral wall surrounding the fan from a radial direction of the rotation axis; and a bell mouth formed along the suction opening of the sidewall. The bell mouth includes upstream and downstream ends, with the upstream end being an end portion on an upstream side in a direction of flow of the air passing through the suction opening, and the downstream end being an end portion on a downstream side in the direction of flow of the air.

8 Claims, 23 Drawing Sheets

Related U.S. Application Data application No. 16/759,021, filed as application No. PCT/JP2018/039585 on Oct. 25, 2018, now abandoned.

(56) References Cited

U.S. PATENT DOCUMENTS

| | | | | |
|---|---|---|---|---|
| 9,017,011 | B2 | 4/2015 | Gatley, Jr. et al. | |
| 2011/0052673 | A1 | 3/2011 | Tzianabos et al. | |
| 2012/0009059 | A1 * | 1/2012 | Okamoto | F04D 29/441 415/224 |
| 2015/0198178 | A1 | 7/2015 | Kawasaki | |
| 2018/0135653 | A1 | 5/2018 | Gebert et al. | |

FOREIGN PATENT DOCUMENTS

| | | | | |
|---|---|---|---|---|
| CN | 204113749 | U | 1/2015 | |
| CN | 104533837 | A | 4/2015 | |
| CN | 104641123 | A | 5/2015 | |
| DE | 10 2015 114 389 | A1 | 3/2017 | |
| FR | 2772437 | A1 | 6/1999 | |
| GB | 2551281 | A | 12/2017 | |
| JP | S60-247099 | A | 12/1985 | |
| JP | S62-8487 | U | 1/1987 | |
| JP | S63-118397 | U | 7/1988 | |
| JP | H08-177795 | A | 7/1996 | |
| JP | 2765946 | B2 | 6/1998 | |
| JP | 2007-127089 | A | 5/2007 | |
| JP | 2008-138618 | A | 6/2008 | |
| JP | 2011-1838 | A | 1/2011 | |
| JP | 2011-052673 | A | 3/2011 | |
| JP | 2011-226407 | A | 11/2011 | |
| JP | 2016-203823 | A | 12/2016 | |
| JP | 2017-110626 | A | 6/2017 | |
| JP | 2017110626 | A * | 6/2017 | F04D 13/06 |
| WO | 2010/137140 | A1 | 12/2010 | |
| WO | 2014/034951 | A1 | 3/2014 | |
| WO | 2016/139732 | A1 | 9/2016 | |

OTHER PUBLICATIONS

International Search Report of the International Searching Authority dated Jan. 22, 2019 for the corresponding international application No. PCT/JP2018/039585 (and English translation).

Extended European Search Report dated Sep. 22, 2020 issued in corresponding EP patent application No. 20181735.0.

Extended European Search Report dated Sep. 22, 2020 issued in corresponding EP patent application No. 20181743.4.

Extended European Search Report dated Oct. 26, 2020 issued in corresponding EP patent application No. 18871715.1.

Office Action dated Dec. 1, 2020, issued in corresponding CN patent application No. 201880070006.2 (and English machine translation).

Office Action dated Feb. 2, 2021 issued in corresponding JP patent application No. 2019-551219 (and English machine translation).

Office Action dated Jan. 18, 2021 issued in corresponding TW patent application No. 109103489 (and English machine translation).

Office Action dated Feb. 5, 2021 issued in corresponding AU patent application No. 2018354693 (with the Examiner's email dated May 7, 2021 for correction of D3 cited reference).

Office Action dated Jun. 29, 2021 issued in corresponding Indian patent application No. 202027017704.

Office Action dated Jul. 5, 2021 issued in corresponding CN patent application No. 201880070006.2 (and English machine translation).

Office Action dated Oct. 4, 2021 issued in corresponding Indonesian patent application No. P00202003071 (and English machine translation).

Office Action dated Jan. 29, 2022 issued in corresponding CN patent application No. 201880070006.2 (and English machine translation).

Office Action dated Mar. 10, 2022 issued in corresponding EP patent application No. 20181735.0.

Office Action dated Mar. 4, 2022 issued in corresponding EP patent application No. 20181743.4.

Office Action dated Jun. 14, 2022 issued in corresponding JP patent application No. 2021-143159 (and English machine translation).

Office Action dated Oct. 28, 2022 for the corresponding AU patent application No. 2022200749.

Office Action dated Oct. 28, 2022 for corresponding AU patent application No. 2022200751.

Office Action dated Feb. 16, 2023 issued in corresponding AU patent application No. 2022200749.

Office Action dated Apr. 18, 2023 issued in corresponding JP patent application No. 2021-143159 (and English machine translation).

Office Action dated Sep. 25, 2023 issued in corresponding EP Patent Application No. 20181735.0.

U.S. Appl. No. 18/453,565, filed Aug. 22, 2023, Teramoto et al.

U.S. Appl. No. 18/453,642, filed Aug. 22, 2023, Teramoto et al.

Office Action dated Mar. 5, 2024 issued in corresponding CN Patent Application No. 202210384786.6 (and partial English machine translation).

* cited by examiner

CENTRIFUGAL BLOWER, AIR-BLOWING APPARATUS, AIR-CONDITIONING APPARATUS, AND REFRIGERATION CYCLE APPARATUS

CROSS REFERENCE TO RELATED APPLICATIONS

This application is a divisional application of U.S. Utility application Ser. No. 17/899,236 filed on Aug. 30, 2022, which is a divisional application of U.S. Utility application Ser. No. 16/759,021 filed on Apr. 24, 2020, which is a U.S. national stage application of International Patent Application No. PCT/JP2018/039585 filed on Oct. 25, 2018, which claims priority to International Patent Application No. PCT/JP2017/038960 filed on Oct. 27, 2017, the contents of which are incorporated herein by reference.

FIELD

The present invention relates to a centrifugal air blower having a scroll casing, and an air-blowing apparatus, an air-conditioning apparatus, and a refrigeration cycle apparatus that include the centrifugal air blower.

BACKGROUND

A scroll casing of a centrifugal air blower has a bell mouth that guides an airflow sucked into a suction opening. If the axial distance between the upstream end and the downstream end of the bell mouth is short in the centrifugal air blower, the direction of the airflow changes suddenly, and turbulence occurs in the flow, resulting in a decrease in air blowing efficiency. Patent Literature 1 discloses a centrifugal air blower in which at least the portion of the bell mouth of the scroll casing having a higher air inflow velocity protrudes outward from the scroll casing.

In the invention disclosed in Patent Literature 1, the axial distance between the upstream end and the downstream end of the bell mouth is partially long, and accordingly, the airflow is gradually changed at the suction opening. Thus, turbulence hardly occurs in the flow, and the decrease in air blowing efficiency can be effectively reduced.

CITATION LIST

Patent Literature

Patent Literature 1: Japanese Patent Application Laid-open No. 5-17400

SUMMARY

Technical Problem

In the invention disclosed in Patent Literature 1, however, the bell mouth is not widened in the radial direction, and therefore, there is room for improvement of the air blowing efficiency.

The present invention has been made in view of the above, and aims to obtain a centrifugal air blower with enhanced air blowing efficiency.

Solution to Problem

To solve the above problem and achieve the object, a centrifugal air blower according to the present invention comprises: a fan including a disk-shaped main plate and a plurality of blades disposed on a peripheral portion of the main plate; and a scroll casing. The scroll casing includes: a sidewall covering the fan from an axial direction of a rotation axis on which the fan rotates, the side wall having a suction opening for sucking air; a discharge opening for discharging an airflow generated by the fan; a tongue portion for guiding the airflow to the discharge opening; a peripheral wall surrounding the fan from a radial direction of the rotation axis; and a bell mouth formed along the suction opening of the sidewall. The bell mouth includes an upstream end and a downstream end, the upstream end being an end portion on an upstream side in a direction of flow of the air passing through the suction opening, the downstream end being an end portion on a downstream side in the direction of flow of the air. A distance in the radial direction of the rotation shaft between the upstream end and the downstream end at a location larger than the tongue portion in angle of a direction of rotation of the fan is longer than a distance in the radial direction between the upstream end and the downstream end at a location adjacent to the tongue portion.

Advantageous Effects of Invention

A centrifugal air blower according to the present invention has an effect of enhancing the air blowing efficiency.

DESCRIPTION OF EMBODIMENTS

The following is a detailed description of a centrifugal air blower, an air-blowing apparatus, an air-conditioning apparatus, and a refrigeration cycle apparatus according to embodiments of the present invention, with reference to the drawings. Note that the present invention is not limited by the embodiments.

First Embodiment

Figure 1:
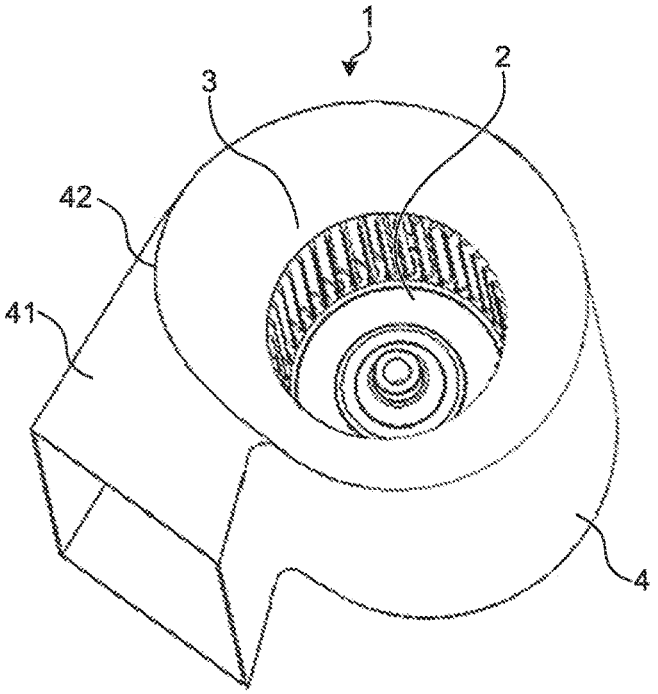
FIG. 1 is a perspective view of an air blower according to a first embodiment of the present invention.
Figure 2:
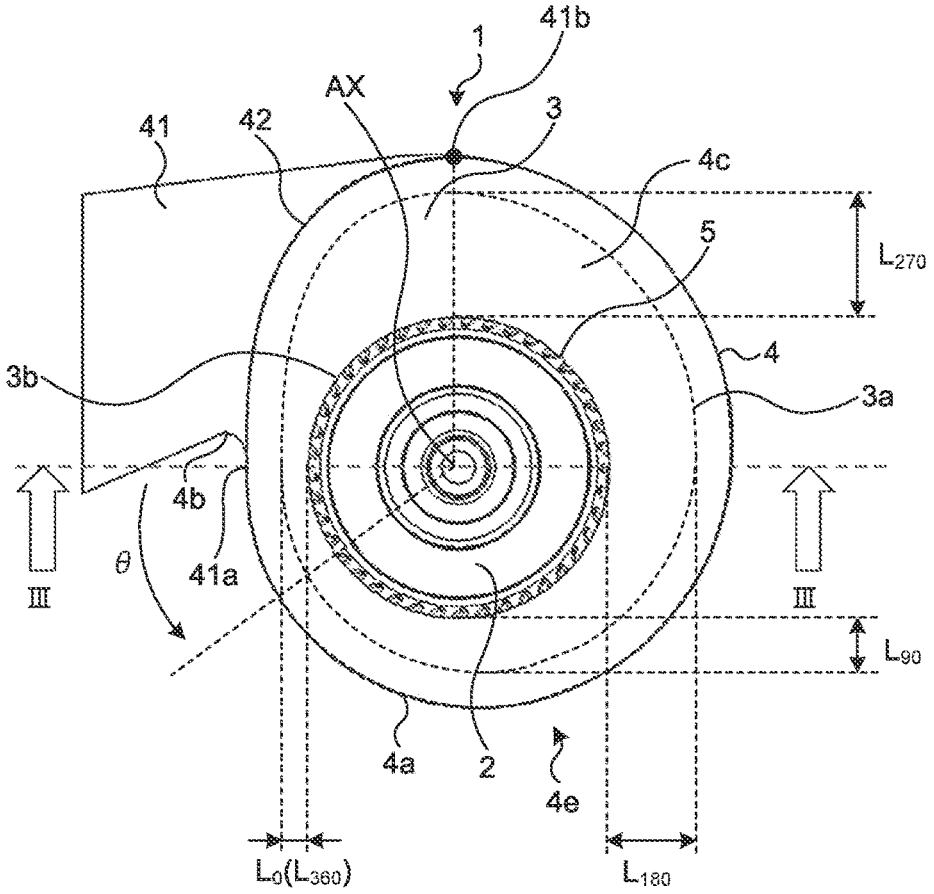
FIG. 2 is a top view of the air blower according to the first embodiment.
Figure 3:
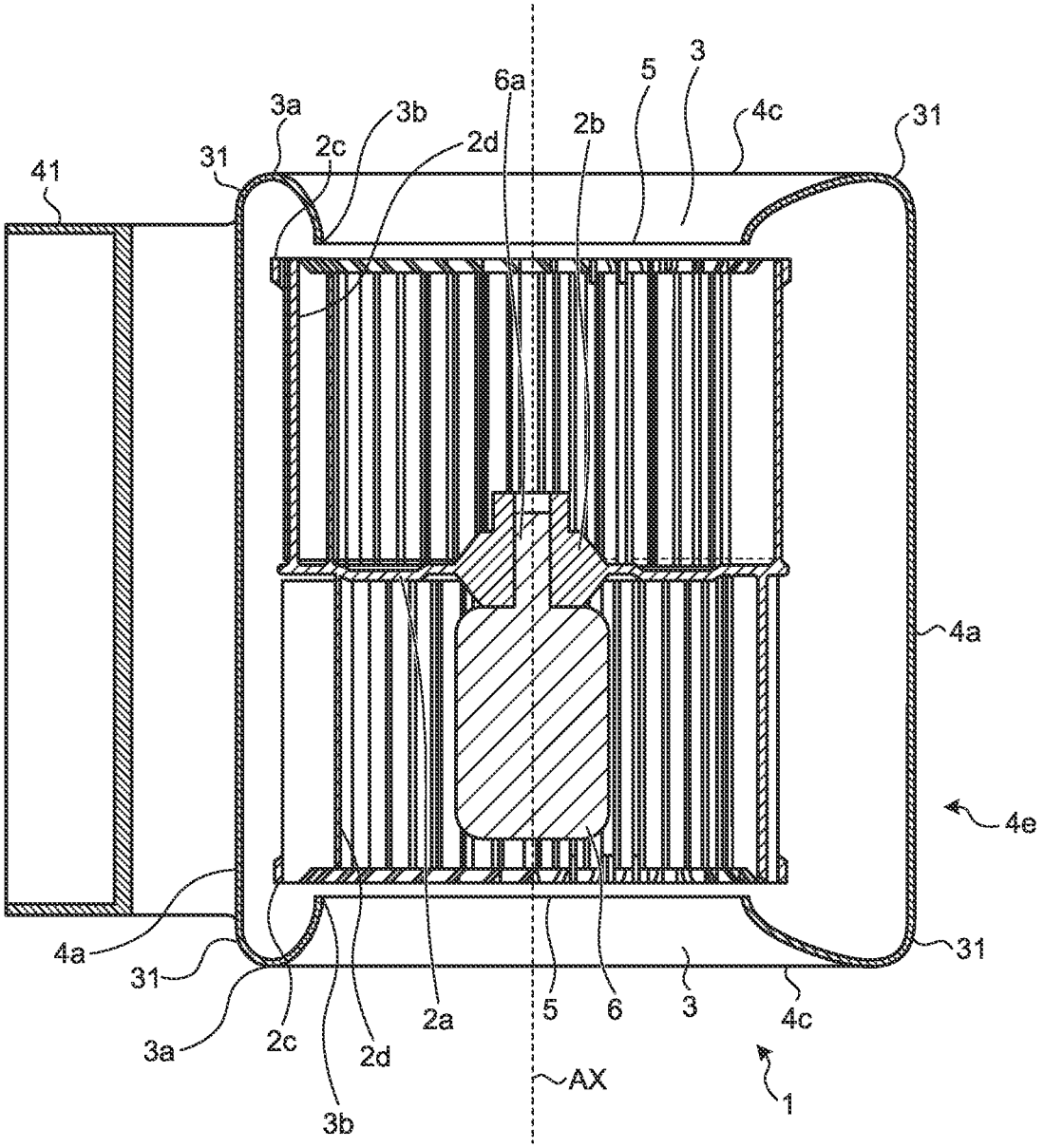
FIG. 3 is a cross-sectional view of the air blower according to the first embodiment.

FIG. 1 is a perspective view of an air blower according to a first embodiment of the present invention. FIG. 2 is a top view of the air blower according to the first embodiment. FIG. 3 is a cross-sectional view of the air blower according to the first embodiment. FIG. 3 illustrates a cross-section taken along line III-III defined in FIG. 2. An air blower 1, which is a multi-blade centrifugal air blower, includes a fan 2 that generates an airflow, and a scroll casing 4 provided with a bell mouth 3 that rectifies an airflow taken into the fan 2.

The fan 2 includes a disk-shaped main plate 2*a*, a ring-shaped side plate 2*c* facing the main plate 2*a*, and a plurality of blades 2*d* disposed at the peripheral portion of the main plate 2*a*. The blades 2*d* surround a rotation axis AX between the main plate 2*a* and the side plate 2*c*. The main plate 2*a* has its central portion providing a boss portion 2*b*. An output shaft 6*a* of a fan motor 6 is connected to the center of the boss portion 2*b*, and the fan 2 is rotated by the driving force of the fan motor 6. Note that the fan 2 may have a structure without the side plate 2*c*.

The scroll casing 4 surrounds the fan 2, and rectifies the air blown from the fan 2. The scroll casing 4 includes a sidewall 4*c*, a peripheral wall 4*a*, a discharge opening 41, and a tongue portion 4*b*. The sidewall 4*c* covers the fan 2 from the axial direction of the rotation axis AX. The peripheral wall 4*a* covers the fan 2 from the radial direction of the rotation axis AX. The discharge opening 41 discharges an airflow generated by the fan 2. The tongue portion 4*b* guides the airflow generated by the fan 2 to the discharge opening 41. Note that the radial direction of the rotation axis AX is a direction perpendicular to the rotation axis AX. The inside of a scroll portion 4*e* defined by the peripheral wall 4*a* and the sidewall 4*c* is a space in which air blown from the fan 2 flows along the peripheral wall 4*a*.

The discharge opening 41 has an end portion 41*a* located on the side of the tongue portion 4*b*, and an end portion 41*b* located on the side away from the tongue portion 4*b*. The peripheral wall 4*a* extends from the end portion 41*a* to the end portion 41*b* in the direction of rotation of the fan 2. Accordingly, the scroll portion 4*e* is contiguous with the discharge opening 41 without the peripheral wall 4*a* being provided therebetween. A distance between the rotation axis AX of the fan 2 and the peripheral wall 4*a* becomes longer as an angle θ relative to the tongue portion 4*b* in the direction of rotation of the fan 2 increases between the tongue portion 4*b* and a location at which the peripheral wall 4*a* is contiguous with the discharge opening 41. The distance between the rotation axis AX of the fan 2 and the peripheral wall 4*a* is shortest at the end portion 41*a*.

A suction opening 5 is formed in the sidewall 4*c* of the scroll casing 4. The sidewall 4*c* defines the bell mouth 3. An airflow to be sucked into the scroll casing 4 through the suction opening 5 is guided by the bell mouth 3. The bell mouth 3 is formed at a position at which the fan 2 faces the suction opening 5. The bell mouth 3 has an upstream end 3*a* and a downstream end 3*b*. The upstream end 3*a* is an end on an upstream side of an airflow to be sucked into the scroll casing 4 through the suction opening 5, and the downstream end 3*b* is an end on a downstream side of the airflow. The bell mouth 3 is shaped to provide an airflow path narrowing from the upstream end 3*a* toward the downstream end 3*b*. In the air blower 1 according to the first embodiment, the bell mouth 3 has a curved surface having a curved cross-sectional shape in the plane including the rotation axis AX. However, the bell mouth 3 may have a curved surface having a linear cross-sectional shape in the plane including the rotation axis AX. In other words, the bell mouth 3 may be like the side face of a circular truncated cone.

The peripheral portion of the bell mouth 3 has a curved portion 31 having a curved surface convex in a direction away from the main plate 2*a*, and smoothly connects the bell mouth 3 and the peripheral wall 4*a* of the scroll casing 4. Here, the phrase "smoothly" means that the tilting of the curved surface continuously changes between the bell mouth 3 and the peripheral wall 4*a*, such that any edge is not formed at the boundary between the bell mouth 3 and the peripheral wall 4*a*.

A step 42 is formed at the boundary between the discharge opening 41 and the scroll portion 4*e*, such that the airflow is reduced in the cross-sectional area as the air flow travels from the scroll portion 4*e* toward the discharge opening 41. Since the cross-sectional area of the airflow that travels from the scroll portion 4*e* toward the discharge opening 41 is reduced, the flow rate of the airflow blown out of the scroll casing 4 through the discharge opening 41 becomes higher.

A radial distance between the upstream end 3*a* and the downstream end 3*b* of the bell mouth 3 is longer at a location where an angle relative to the end portion 41*a* in the direction of rotation of the fan 2 is larger between the end portion 41*a* and the end portion 41*b*.

$L_\theta$ represents the radial distance between the upstream end 3*a* and the downstream end 3*b* of the bell mouth 3 at a location where an angle relative to the end portion 41*a* in the direction of rotation of the fan 2 is θ degrees. $L_\theta$ can be defined as the distance between the upstream end 3*a* and the downstream end 3*b* on the line segment interconnecting the end portion 41*a* and the rotation axis AX as viewed from above. Further, $L_{270}$ can be defined as the distance between the upstream end 3*a* and the downstream end 3*b* on the line segment interconnecting the end portion 41*b* and the rotation axis AX as viewed from above. In the air blower 1 according to the first embodiment, $L_{90}$ is longer than $L_0$, and $L_{180}$ is longer than $L_{90}$. The radial distance L between the upstream end 3*a* and the downstream end 3*b* of the bell mouth 3 becomes longest at $L_{270}$ where the scroll casing 4 is connected to the discharge opening 41, after which the radial distance L becomes shortest at $L_{360}$ corresponding to the end portion 41*a*. For example, the radial distance $L_\theta$ between the upstream end 3*a* and the downstream end 3*b* of the bell mouth 3 becomes longer as the angle θ increases in the range of 0 degrees to 270 degrees. The radial distance $L_\theta$ between the upstream end 3*a* and the downstream end 3*b* of the bell mouth 3 may continuously become longer from the end portion 41*a* toward the end portion 41*b*, or may become longer stepwise. Note that the angle at which the radial distance between the upstream end 3*a* and the downstream end 3*b* of the bell mouth 3 becomes longest may be any angle between 0 degrees and 360 degrees, and is not limited to 270 degrees as illustrated as an example. In other words, the radial distance between the upstream end 3*a* and the downstream end 3*b* of the bell mouth 3 may become longest at a location where the angle relative to the end portion 41*a* in the direction of rotation of the fan 2 is between 0 degrees and 360 degrees, and may become gradually shorter in the direction of the rotation of the fan 2.

Here, the peripheral wall 4*a* is continuous with the discharge opening 41 at a location where the angle relative to the end portion 41*a* in the direction of rotation of the fan 2 is 270 degrees. However, the peripheral wall 4*a* may be contiguous with the discharge opening 41 at a location where the angle relative to the end portion 41*a* is any angle other than 270 degrees.

When the fan 2 rotates, the air outside the scroll casing 4 is sucked into the scroll casing 4 through the suction opening 5. The air sucked into the scroll casing 4 is guided by the bell mouth 3 and is sucked into the fan 2. The air sucked into the fan 2 is blown out of the fan 2 in the radial direction toward the outside. The air blown out of the fan 2 passes through the scroll portion 4*e*, and is then blown out of the scroll casing 4 through the discharge opening 41.

Since the distance between the upstream end 3*a* and the downstream end 3*b* of the bell mouth 3 at any location other than the end portion 41*a* is longer than the distance between the upstream end 3*a* and the downstream end 3*b* at the end portion 41*a*, the airflow sucked into the scroll casing 4 through the suction opening 5 is not easily separated from the bell mouth 3. Thus, the air blower 1 according to the first embodiment can reduce the decrease in air blowing efficiency, and reduce noise.

In the air blower 1 according to the first embodiment, the bell mouth 3 and the peripheral wall 4*a* of the scroll casing 4 are smoothly connected to each other by the curved portion 31. Thus, the air on the side of the peripheral wall 4*a* flows along the curved portion 31, and is guided to the bell mouth 3. Since the boundary portion between the bell mouth 3 and the peripheral wall 4*a* of the scroll casing 4 is defined by the curved portion 31, air blowing efficiency is enhanced.

Figure 4:
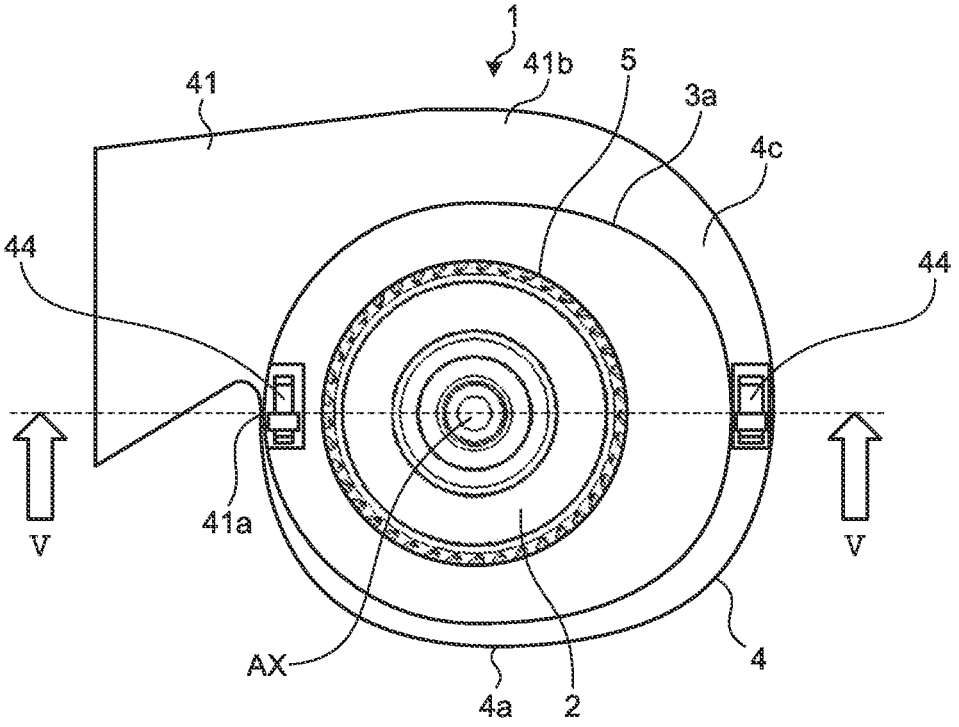
FIG. 4 is a top view illustrating a first modification of the air blower according to the first embodiment.
Figure 5:
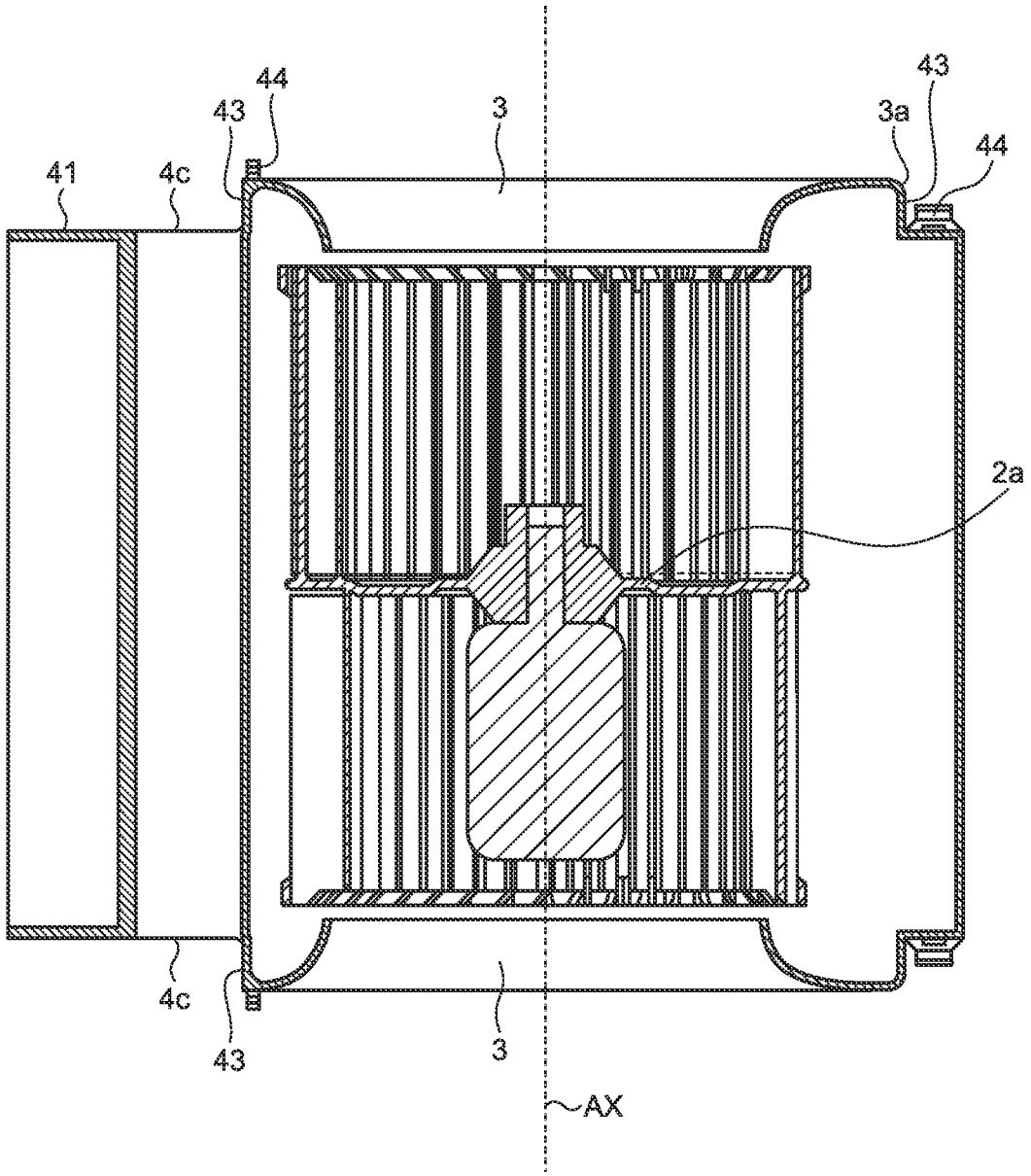
FIG. 5 is a cross-sectional view illustrating the first modification of the air blower according to the first embodiment.

FIG. 4 is a top view illustrating a first modification of the air blower according to the first embodiment. FIG. 5 is a cross-sectional view illustrating the first modification of the air blower according to the first embodiment. FIG. 5 illustrates a cross-section taken along line V-V defined in FIG. 4. In the air blower 1 according to the first modification, the scroll casing 4 is defined by two components joined together. The two components have their engaging portions 44 each defined by a recessed portion of one of the components and a protruding portion of the other component, the recessed portion and the protruding portion engaging each other. One of the two engaging portions 44 is disposed on the sidewall 4*c* between the upstream end 3*a* of the bell mouth 3 and the peripheral wall 4*a* of the scroll casing 4. Note that the engaging portion 44 may be provided at the connecting portion 43 that interconnects the upstream end 3*a* and the sidewall 4*c*.

In the air blower 1 according to the first modification of the first embodiment, at least one of the engaging portions 44 that join the components of the bell mouth 3 is disposed between the upstream end 3*a* of the bell mouth 3 and the peripheral wall 4*a* of the scroll casing 4 and closer to the main plate 2*a* in the axial direction of the rotation axis AX than the upstream end 3*a*. Accordingly, it is less likely that the airflow sucked into the scroll casing 4 through the suction opening 5 is hindered by the engaging portion 44. Thus, the air blower 1 according to the first modification can achieve a higher air blowing efficiency than an air blower that has all the engaging portions disposed between the upstream end of the bell mouth and the suction opening.

As described above, in the air blower 1 according to the first embodiment, the radial distance between the upstream end 3*a* and the downstream end 3*b* of the bell mouth 3 increases in the direction of rotation of the fan 2 from the radial distance between the upstream end 3*a* and the downstream end 3*b* at the end portion 41*a*. As a result, separation of the flow in the bell mouth 3 can be reduced or prevented. Thus, the air blower 1 according to the first embodiment can achieve a higher efficiency and reduce noise by reducing or preventing the separation of the flow in the bell mouth 3.

Figure 6:
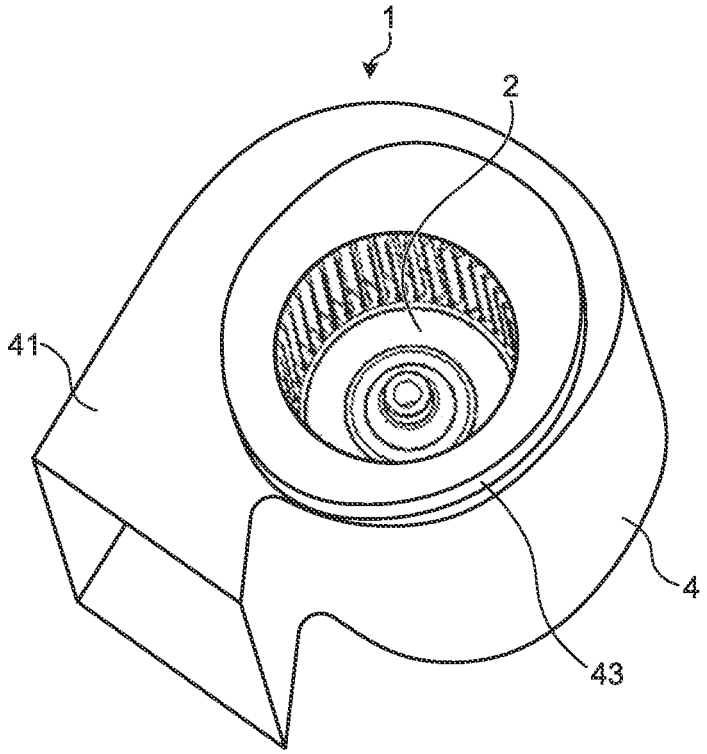
FIG. 6 is a perspective view illustrating a second modification of the air blower according to the first embodiment.
Figure 7:
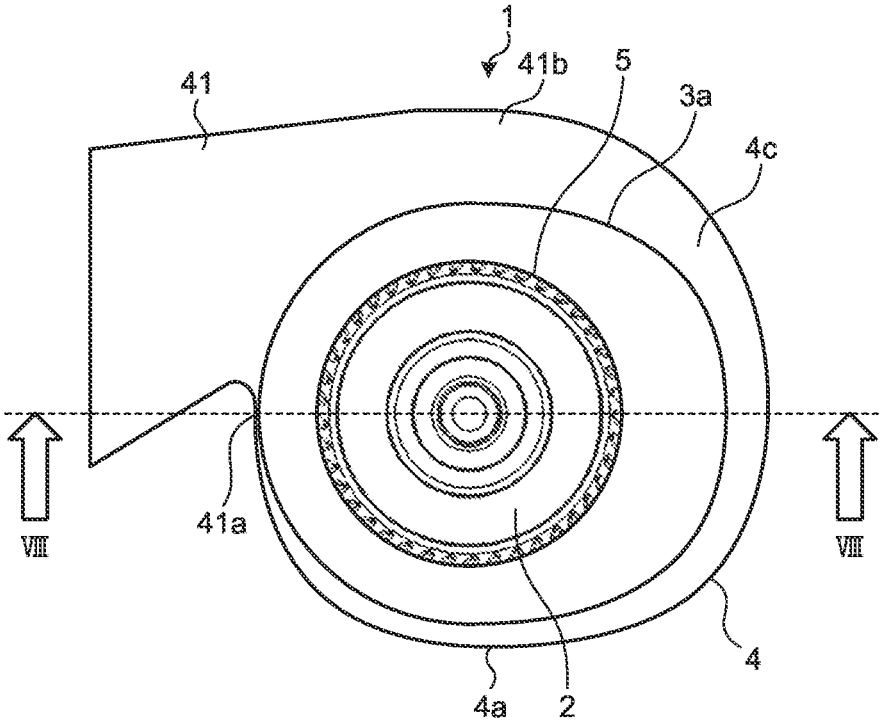
FIG. 7 is a top view illustrating the second modification of the air blower according to the first embodiment.
Figure 8:
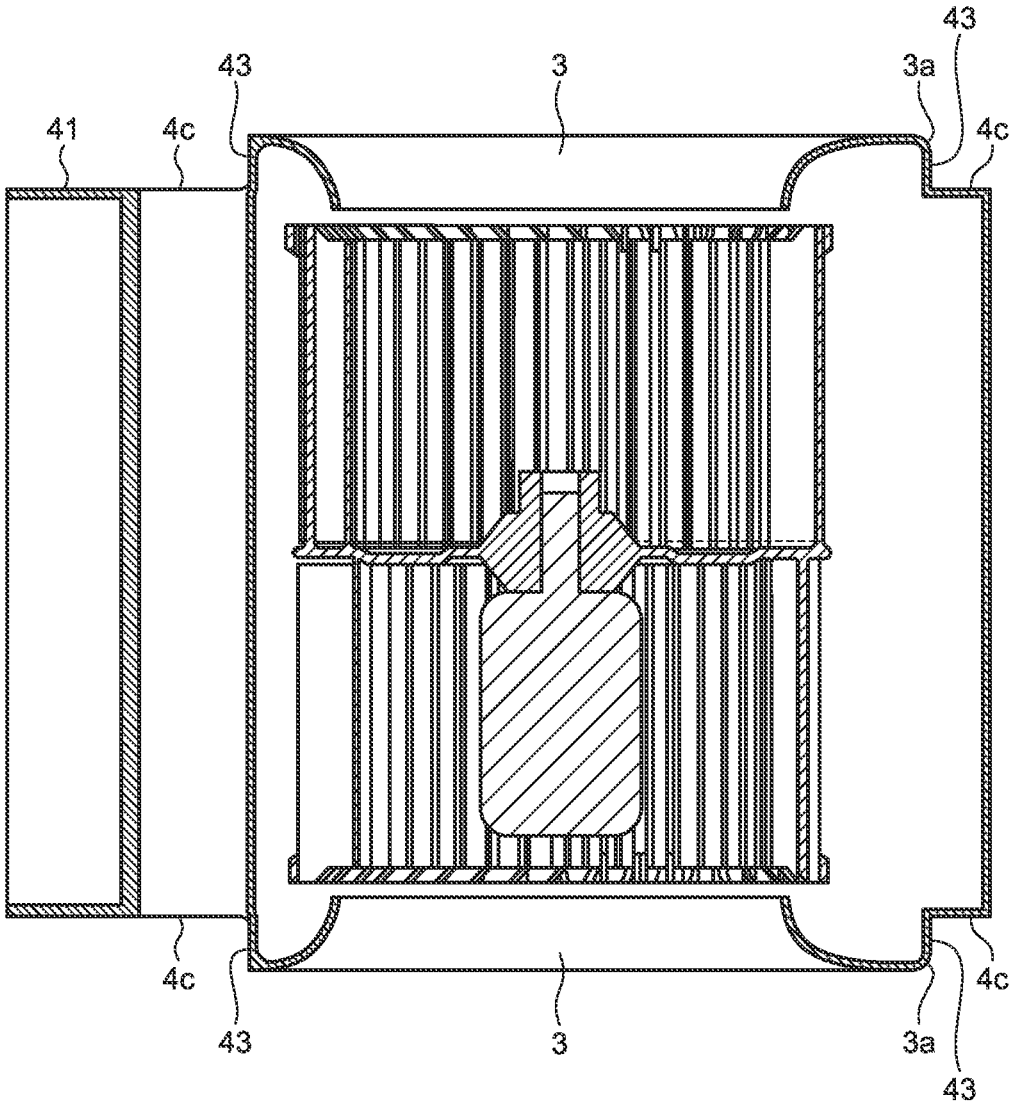
FIG. 8 is a cross-sectional view illustrating the second modification of the air blower according to the first embodiment.

Note that the bell mouth 3 does not necessarily reach the peripheral wall 4*a* of the scroll casing 4 at any portion other than the end portion 41*a*. FIG. 6 is a perspective view illustrating a second modification of the air blower according to the first embodiment. FIG. 7 is a top view illustrating the second modification of the air blower according to the first embodiment. FIG. 8 is a cross-sectional view illustrating the second modification of the air blower according to the first embodiment. FIG. 8 illustrates a cross-section taken along line VIII-VIII in FIG. 7. The upstream end 3*a* of the bell mouth 3 and the sidewall 4*c* are connected to each other by the connecting portion 43. The air blower 1 illustrated in FIGS. 6 through 8 is the same as the air blower 1 illustrated in FIGS. 1 through 3, except that the bell mouth 3 does not reach the peripheral wall 4*a* of the scroll casing 4 at any portion other than the end portion 41*a*. Even the structure designed to provide the bell mouth 3 not reaching the peripheral wall 4*a* of the scroll casing 4 at any portion other than the end portion 41*a* can achieve the effect of reducing or preventing the separation of the flow in the bell mouth 3 provided that the radial distance between the upstream end 3*a* and the downstream end 3*b* of the bell mouth 3 increases in the direction of rotation of the fan 2 from the radial distance between the upstream end 3*a* and the downstream end 3*b* of the bell mouth 3 at the end portion 41*a*.

Figure 9:
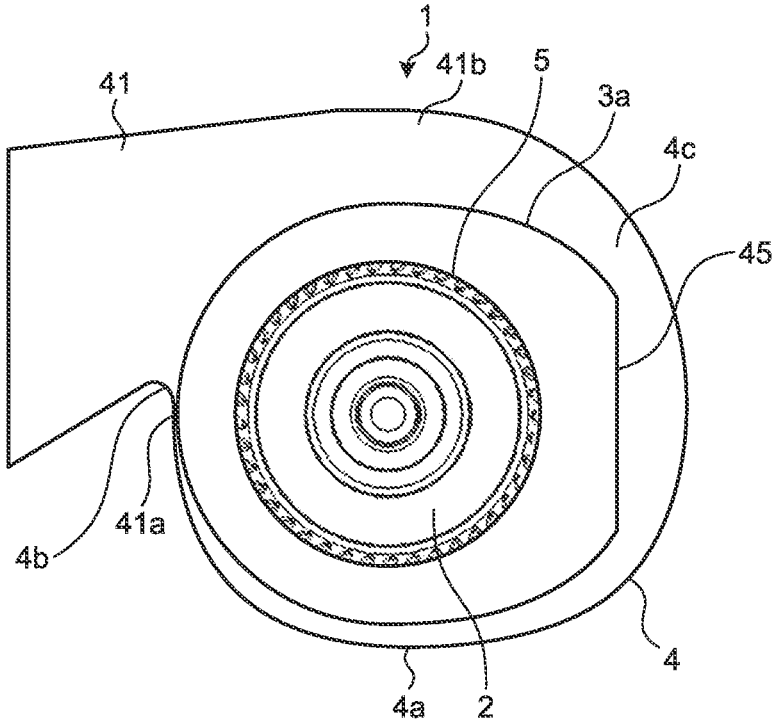
FIG. 9 is a top view illustrating a third modification of the air blower according to the first embodiment.

FIG. 9 is a top view illustrating a third modification of the air blower according to the first embodiment. In the air blower 1 illustrated in FIG. 9, the upstream end 3*a* of the bell mouth 3 and the sidewall 4*c* are connected to each other by the connecting portion 43, as in the air blower 1 illustrated in FIGS. 6 through 8. The air blower 1 according to the third modification has a flat surface portion 45 at which the bell mouth 3 has its linear outer contour when viewed from the axial direction of the rotation axis AX of the fan 2. As illustrated in FIG. 9, the flat surface portion 45 is defined by an opposite portion to the tongue portion 4*b*. At the opposite portion of the scroll casing 4 to the tongue portion 4*b*, the angle relative to the end portion 41*a* in the direction of rotation of the fan 2 is larger than 120 degrees but is smaller than 240 degrees. The flat surface portion 45 illustrated in FIG. 9 has its center at which the angle relative to the end portion 41*a* in the direction of rotation of the fan 2 is 180 degrees. In the air blower 1 according to the third modification, the pressure fluctuation in the bell mouth 3 can be reduced or prevented by the flat surface portion 45, and thus, noise can be reduced.

Figure 10:
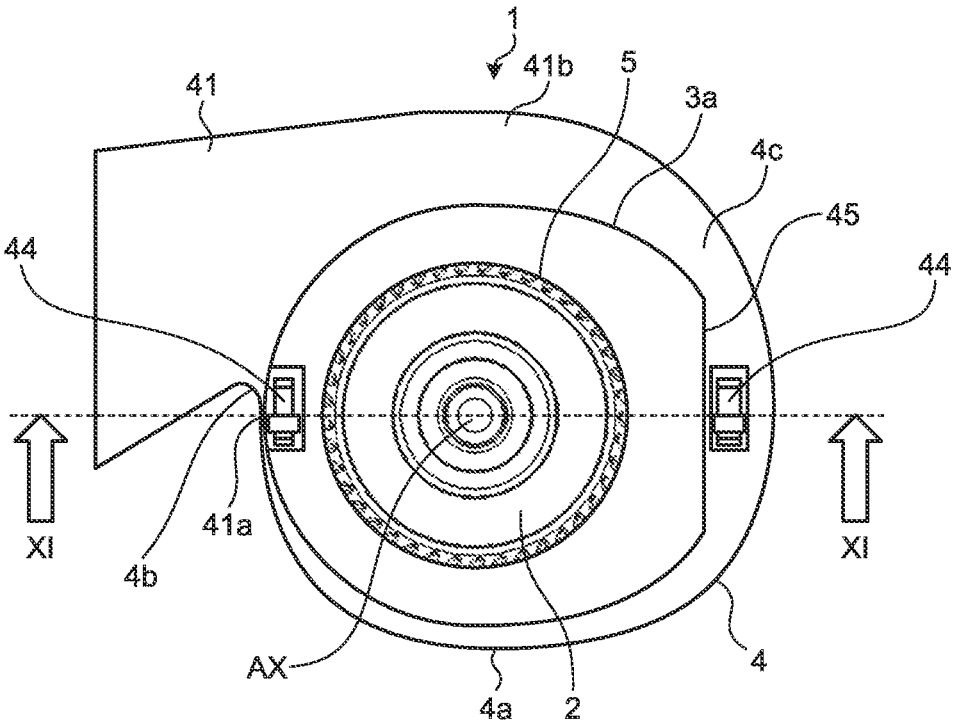
FIG. 10 is a top view illustrating a fourth modification of the air blower according to the first embodiment.
Figure 11:
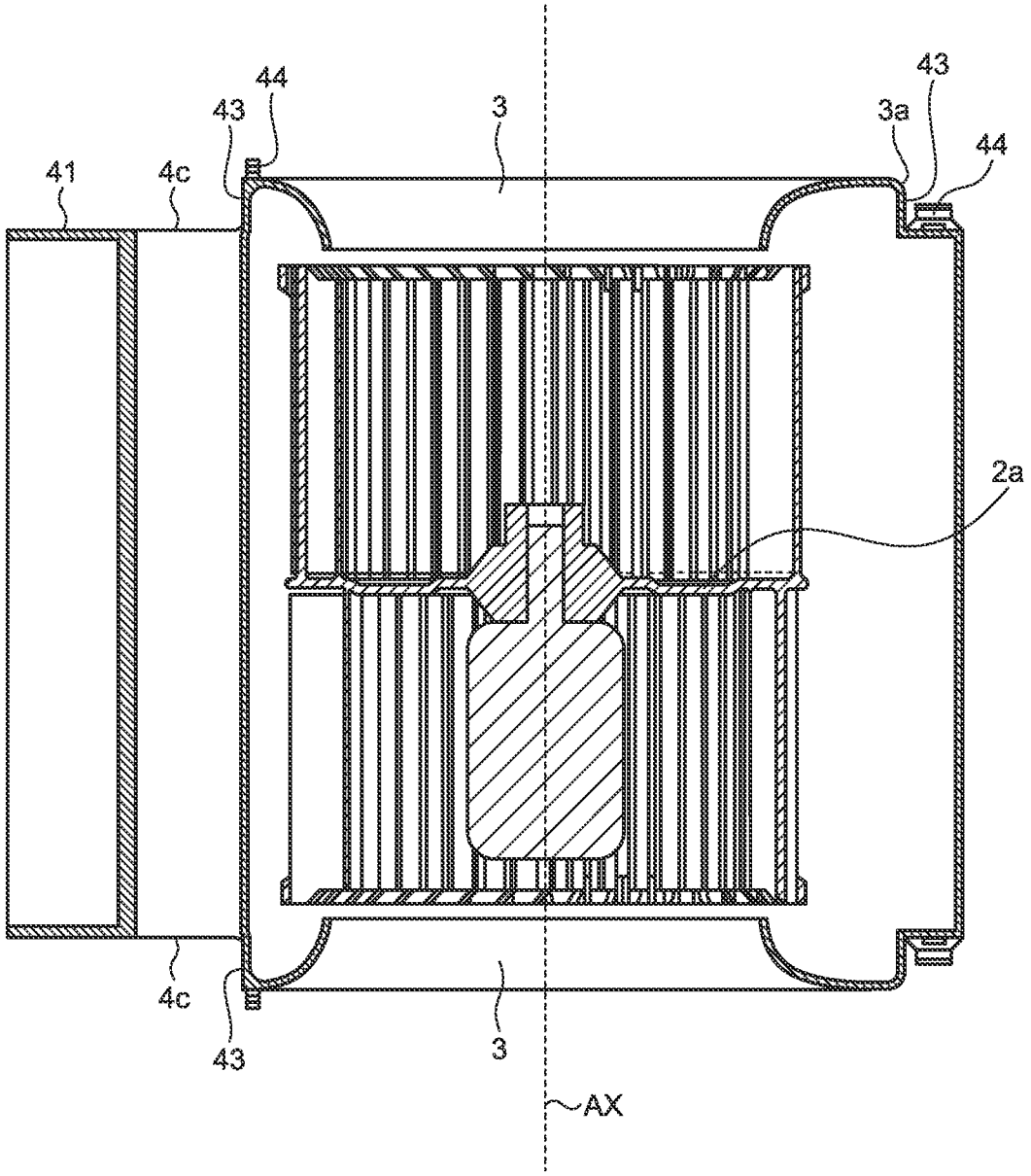
FIG. 11 is a cross-sectional view illustrating the fourth modification of the air blower according to the first embodiment.

FIG. 10 is a top view illustrating a fourth modification of the air blower according to the first embodiment. FIG. 11 is a cross-sectional view illustrating the fourth modification of the air blower according to the first embodiment. FIG. 11 illustrates a cross-section taken along line XI-XI in FIG. 10. In the air blower 1 according to the fourth modification, one of the two engaging portions 44 is located between the upstream end 3*a* of the bell mouth 3 and the peripheral wall 4*a* of the scroll casing 4 and closer to the main plate 2*a* than the upstream end 3*a* in the axial direction of the rotation axis AX. In the air blower 1 according to the fourth modification, the engaging portion 44 is located below the upstream end 3*a* of the bell mouth 3. Thus, it is possible to achieve the effect of reducing or preventing separation of the flow in the bell mouth 3, without obstructing the airflow sucked into the bell mouth 3.

Figure 12:
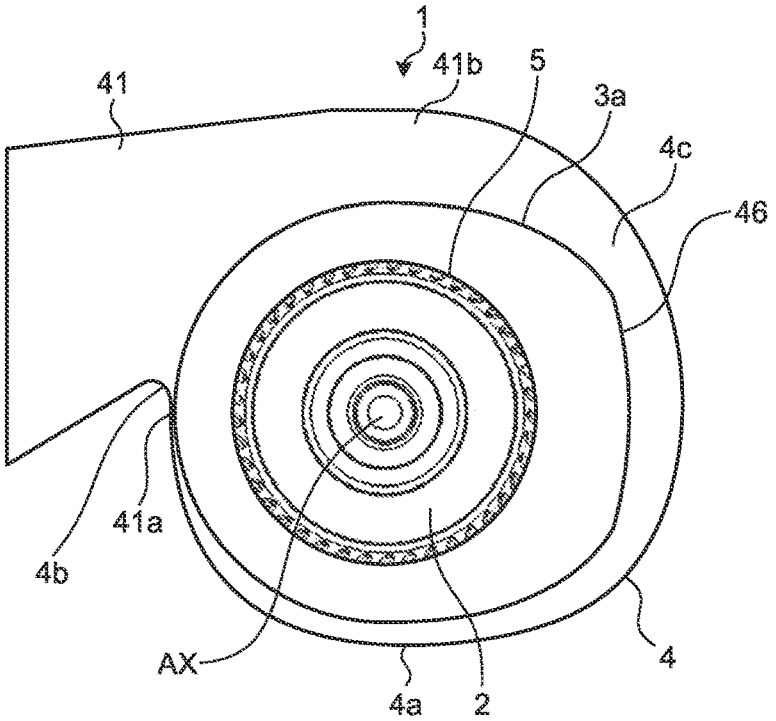
FIG. 12 is a top view illustrating a fifth modification of the air blower according to the first embodiment.

FIG. 12 is a top view illustrating a fifth modification of the air blower according to the first embodiment. The air blower 1 illustrated in FIG. 12 has a curved surface portion 46 at which the bell mouth 3 has its outer contour that is a curved line protruding in a direction away from the rotation axis AX and partially having a small curvature, when viewed from the axial direction of the rotation axis AX of the fan 2. The air blower 1 according to the fifth modification, which has the curved surface portion 46 provided oppositely to the tongue portion 4*b*, can reduce sudden pressure fluctuations in the bell mouth 3. Thus, noise can be reduced more than in the third modification having the flat surface portion 45.

Figure 13:
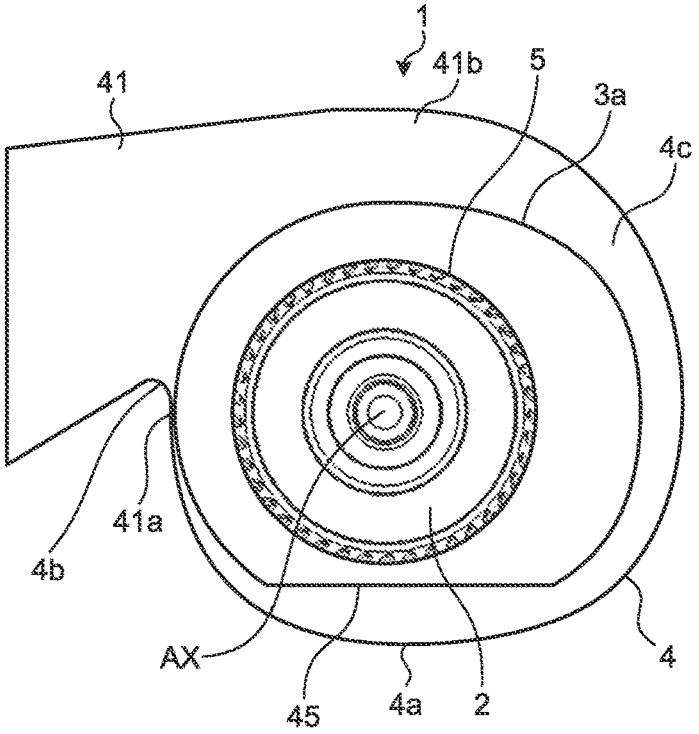
FIG. 13 is a top view illustrating a sixth modification of the air blower according to the first embodiment.

FIG. 13 is a top view illustrating a sixth modification of the air blower according to the first embodiment. In the air blower 1 illustrated in FIG. 13, the scroll casing 4 has a "curling start" portion defining the flat surface portion 45. The "curling start" portion of the scroll casing 4 is a portion at which the angle relative to the end portion 41*a* in the direction of rotation of the fan 2 is larger than 0 degrees but is smaller than 120 degrees. The flat surface portion 45 illustrated in FIG. 13 has its center at which the angle relative to the end portion 41*a* in the direction of rotation of the fan 2 is 90 degrees. The air blower 1 according to the sixth modification, which provides the curling start portion of the scroll casing 4 with the flat surface portion 45, can reduce pressure fluctuation in the bell mouth 3 at the portion of the start of the curling start portion of the scroll casing 4, and thus, reduce noise.

Figure 14:
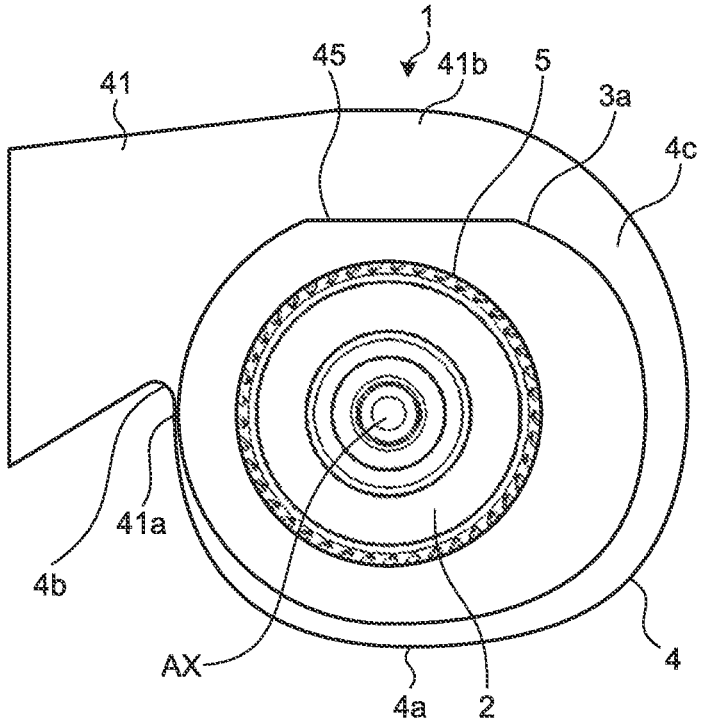
FIG. 14 is a top view illustrating a seventh modification of the air blower according to the first embodiment.

FIG. 14 is a top view illustrating a seventh modification of the air blower according to the first embodiment. In the air blower 1 illustrated in FIG. 14, the scroll casing 4 has a "curling end" portion defining the flat surface portion 45. The "curling end" portion of the scroll casing 4 is a portion at which the angle relative to the end portion 41*a* in the direction of rotation of the fan 2 is larger than 240 degrees but is smaller than 360 degrees. The flat surface portion 45 illustrated in FIG. 14 has its center at which the angle relative to the end portion 41*a* in the direction of rotation of the fan 2 is 270 degrees. The air blower 1 according to the seventh modification, which provides the curling end portion of the scroll casing 4 with the flat surface portion 45, can reduce pressure fluctuation in the bell mouth 3, and thus, reduce noise.

Modifications 3 through 7 described above can be combined. For example, providing at least one of the curling start portion of the scroll casing 4, the curling end portion of the scroll casing 4, and the location opposite to the tongue portion 4*b* with the flat surface portion 45 or the curved surface portion 46 can reduce noise. Further, the curling start portion of the scroll casing 4 may be provided with the curved surface portion 46, as well as the engaging portion 44 being provided closer to the main plate 2*a* than the upstream end 3*a* in the axial direction of the rotation axis AX and between the upstream end 3*a* of the bell mouth 3 and the peripheral wall 4*a* of the scroll casing 4.

Second Embodiment

Figure 15:
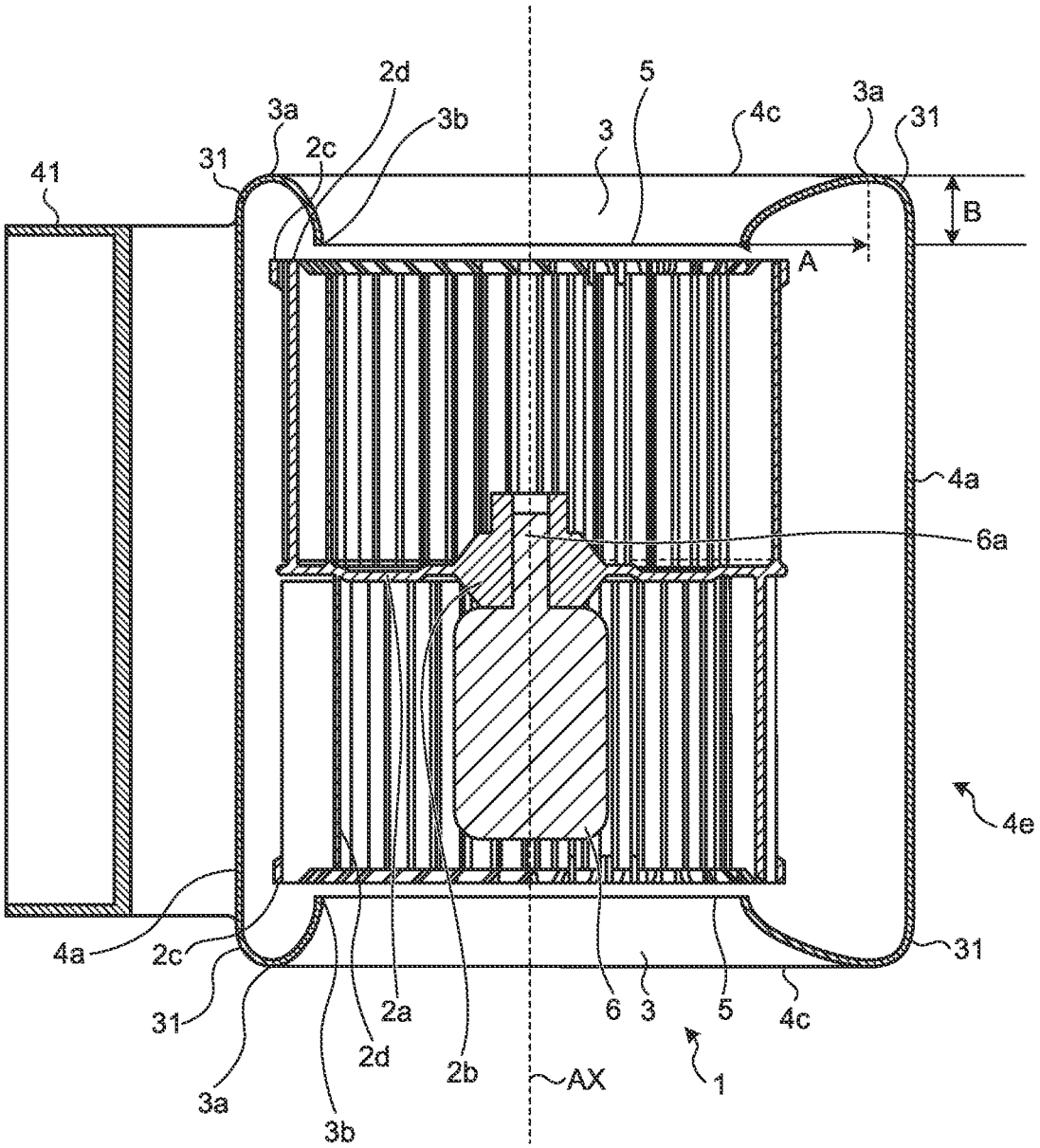
FIG. 15 is a cross-sectional view of an air blower according to a second embodiment of the present invention.

FIG. 15 is a cross-sectional view of an air blower according to a second embodiment of the present invention. In the air blower 1 according to the second embodiment, the radial distance A between the upstream end 3*a* and the downstream end 3*b* of the bell mouth 3 is longer than the axial distance B between the upstream end 3*a* and the downstream end 3*b* of the bell mouth 3, which is expressed as A>B.

In the air blower 1 according to the second embodiment, the curvature of the bell mouth 3 from the upstream end 3*a* to the downstream end 3*b* is smaller than that the curvature of the bell mouth providing an arc-shaped cross-section where A=B. As a result, the air blower 1 according to the second embodiment provides the greater effect of making it separation of the suction airflow from the bell mouth 3 unlikely than an air blower with the bell mouth having the arc-shaped cross-section where A=B.

Third Embodiment

Figure 16:
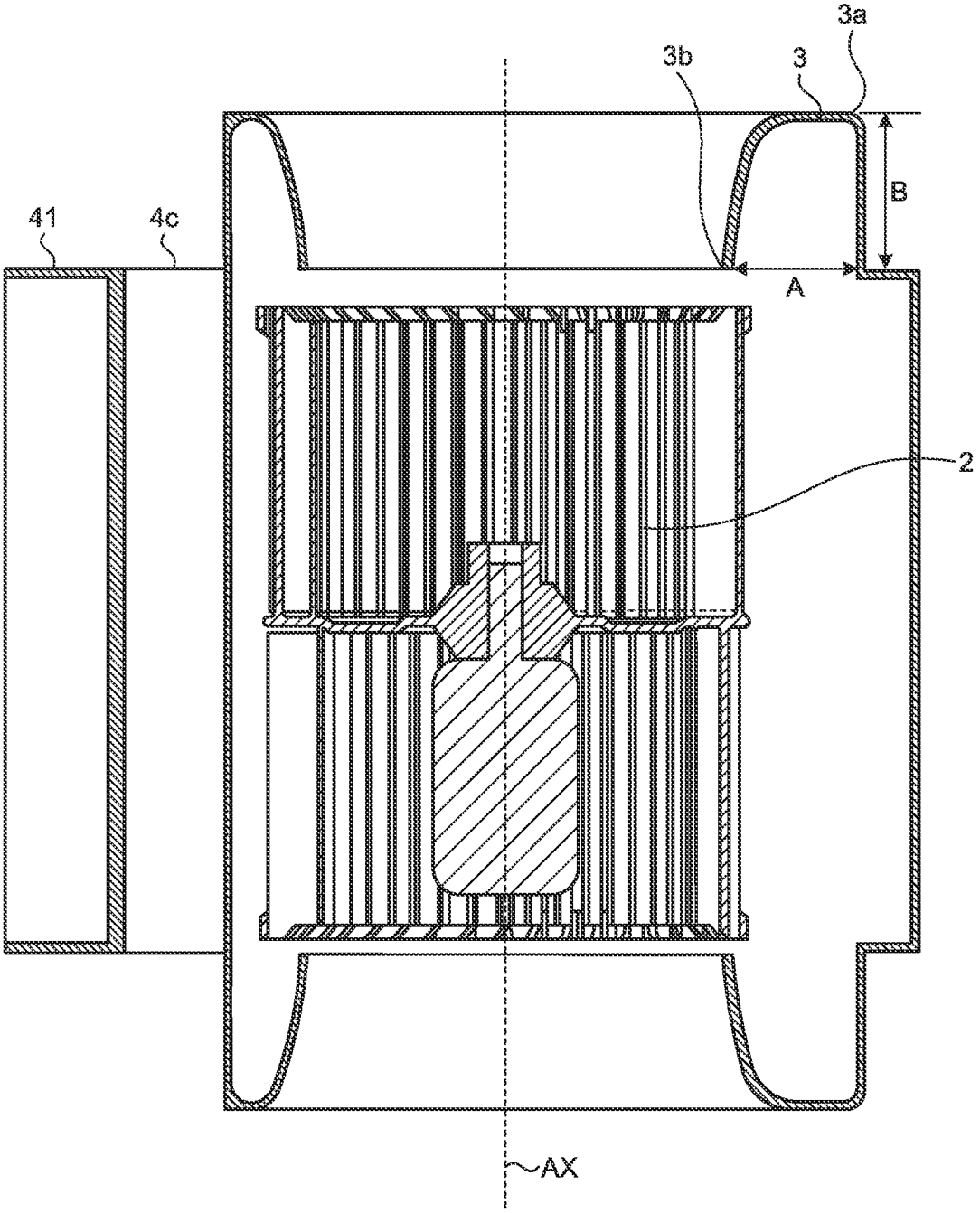
FIG. 16 is a cross-sectional view of an air blower according to a third embodiment of the present invention.

FIG. 16 is a cross-sectional view of an air blower according to a third embodiment of the present invention. In the air blower 1 according to the third embodiment, the distance B in the axial direction of the rotation axis AX between the upstream end 3*a* and the downstream end 3*b* of the bell mouth 3 is longer than the distance A in the radial direction between the upstream end 3*a* and the downstream end 3*b* of the bell mouth 3, which is expressed as A<B.

In a case where the distance B is longer than the distance A, the curvature of the bell mouth 3 from the upstream end 3*a* to the downstream end 3*b* is smaller than the curvature of the bell mouth providing the arc-shaped cross-section where the distance A=the distance B. Also, the suction airflow is changed by the axial direction of the rotation axis AX in the bell mouth 3 from the upstream end 3*a* to the downstream end 3*b*, and thus, an airflow that is uniform in the axial direction can be sent into the fan 2. As a result, the air blower 1 according to the third embodiment provides an increased power of the fan 2 in the axial direction of the rotation axis AX. Thus, it is possible to achieve a higher efficiency, and reduce noise.

Fourth Embodiment

Figure 17:
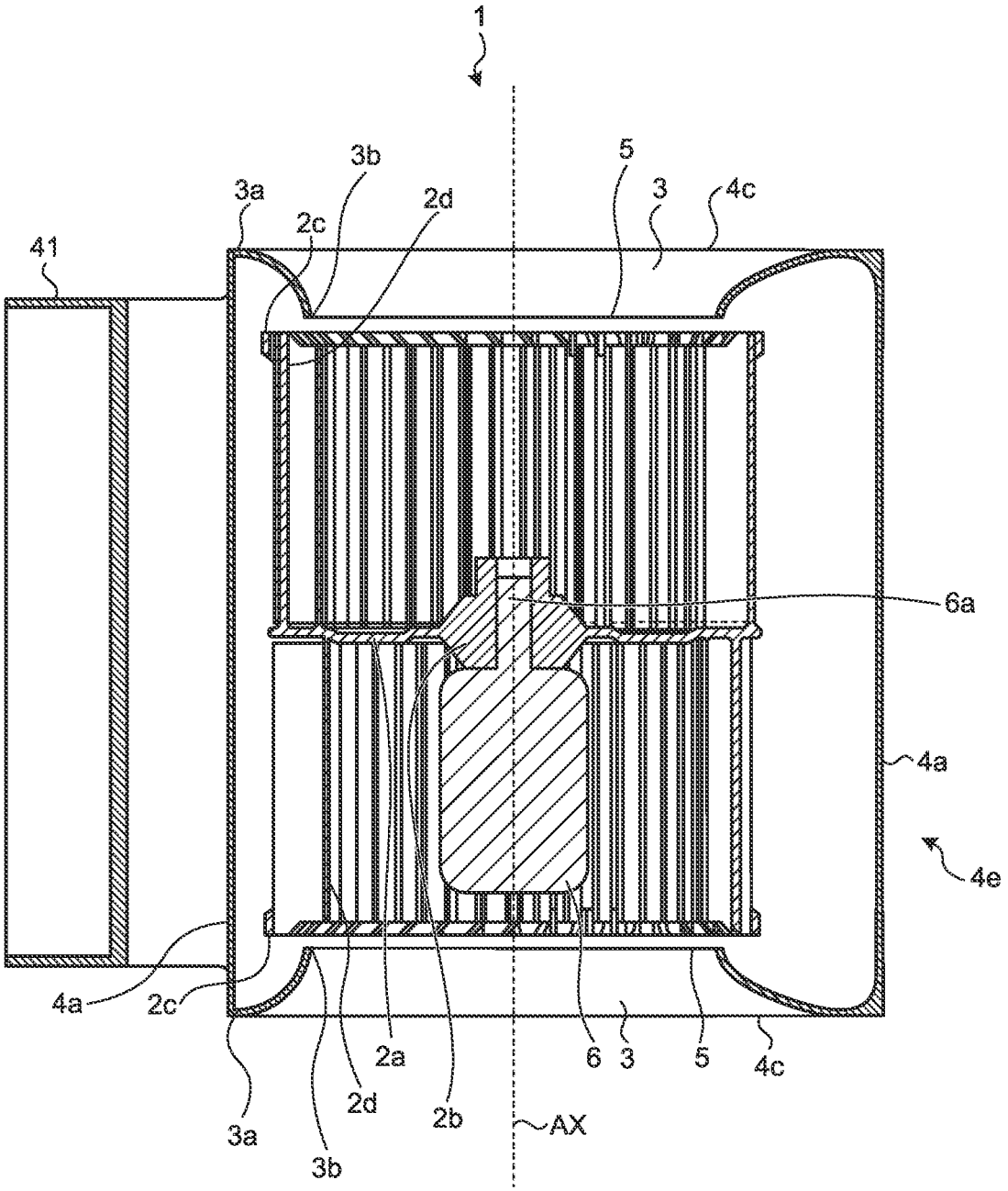
FIG. 17 is a cross-sectional view of an air blower according to a fourth embodiment of the present invention.

FIG. 17 is a cross-sectional view of an air blower according to a fourth embodiment of the present invention. In the air blower 1 according to the fourth embodiment, the curved portion 31 is not formed at the peripheral portion of bell mouth 3, and the upstream end 3*a* of the bell mouth 3 is located at the end portion of the peripheral wall 4*a*. The other aspects are the same as those of the air blower 1 according to the first embodiment.

The air blower 1 according to the fourth embodiment has a lower air blowing efficiency than that of the air blower 1 according to the first embodiment having the curved portion 31 formed at the boundary between the peripheral wall 4*a* and the bell mouth 3. However, the air blower 1 according to the fourth embodiment achieves a high efficiency and reduces noise as compared to an air blower designed such that the radial distance between the upstream end 3*a* and the downstream end 3*b* of the bell mouth 3 is uniform regardless of the angle relative to the end portion 41*a* in the direction of rotation of the fan 2.

Fifth Embodiment

Figure 18:
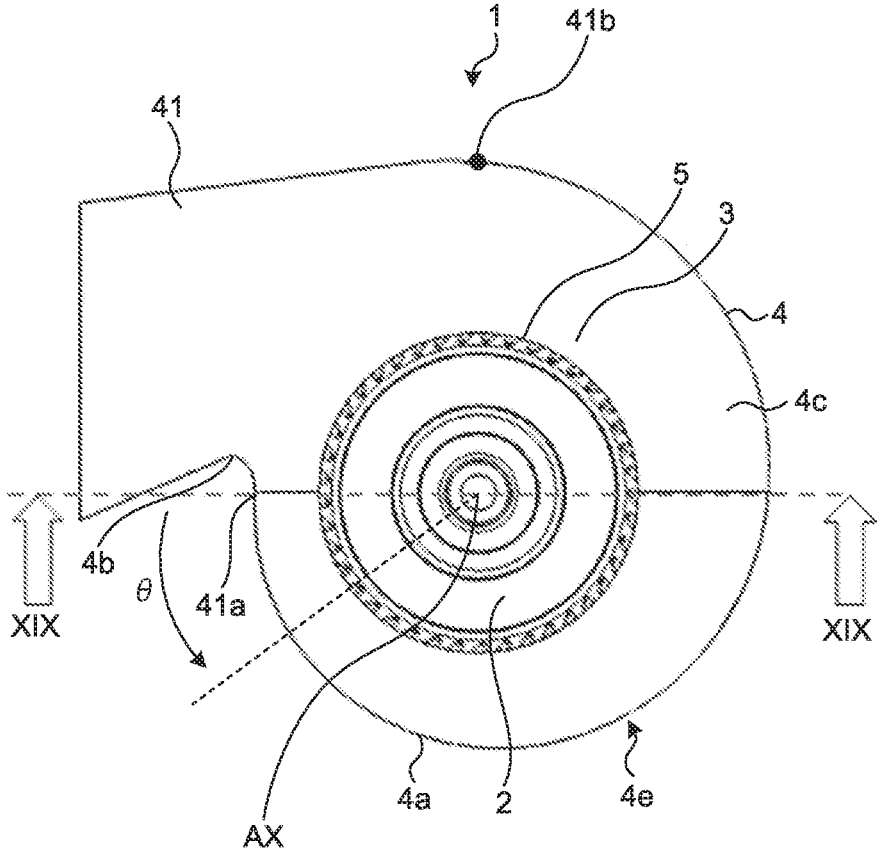
FIG. 18 is a top view of an air blower according to a fifth embodiment of the present invention.
Figure 19:
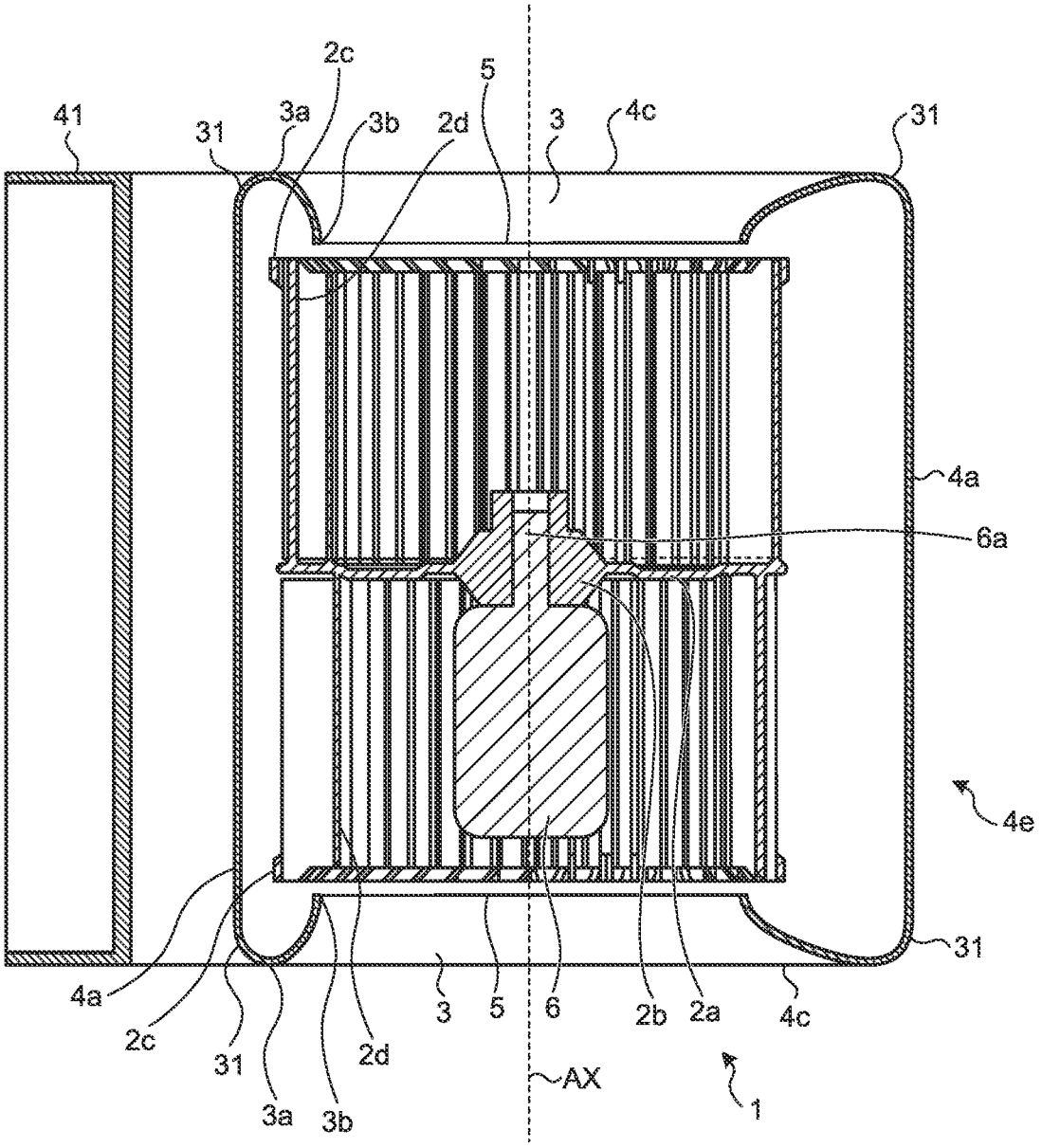
FIG. 19 is a cross-sectional view of an air blower according to the fifth embodiment.

FIG. 18 is a top view of an air blower according to a fifth embodiment of the present invention. FIG. 19 is a cross-sectional view of the air blower according to the fifth embodiment. FIG. 19 illustrates a cross-section taken along line XIX-XIX in FIG. 18. The air blower 1 according to the fifth embodiment differs from the first embodiment in that the step 42 is not formed at the boundary between the scroll portion 4*e* and the discharge opening 41.

In the air blower 1 according to the fifth embodiment, the airflow generated by the fan 2 does not receive resistance due to passing through the step within the scroll portion 4*e* as the airflow travels from the scroll portion 4*e* to the discharge opening 41. Thus, air blowing efficiency can be enhanced.

Sixth Embodiment

Figure 20:
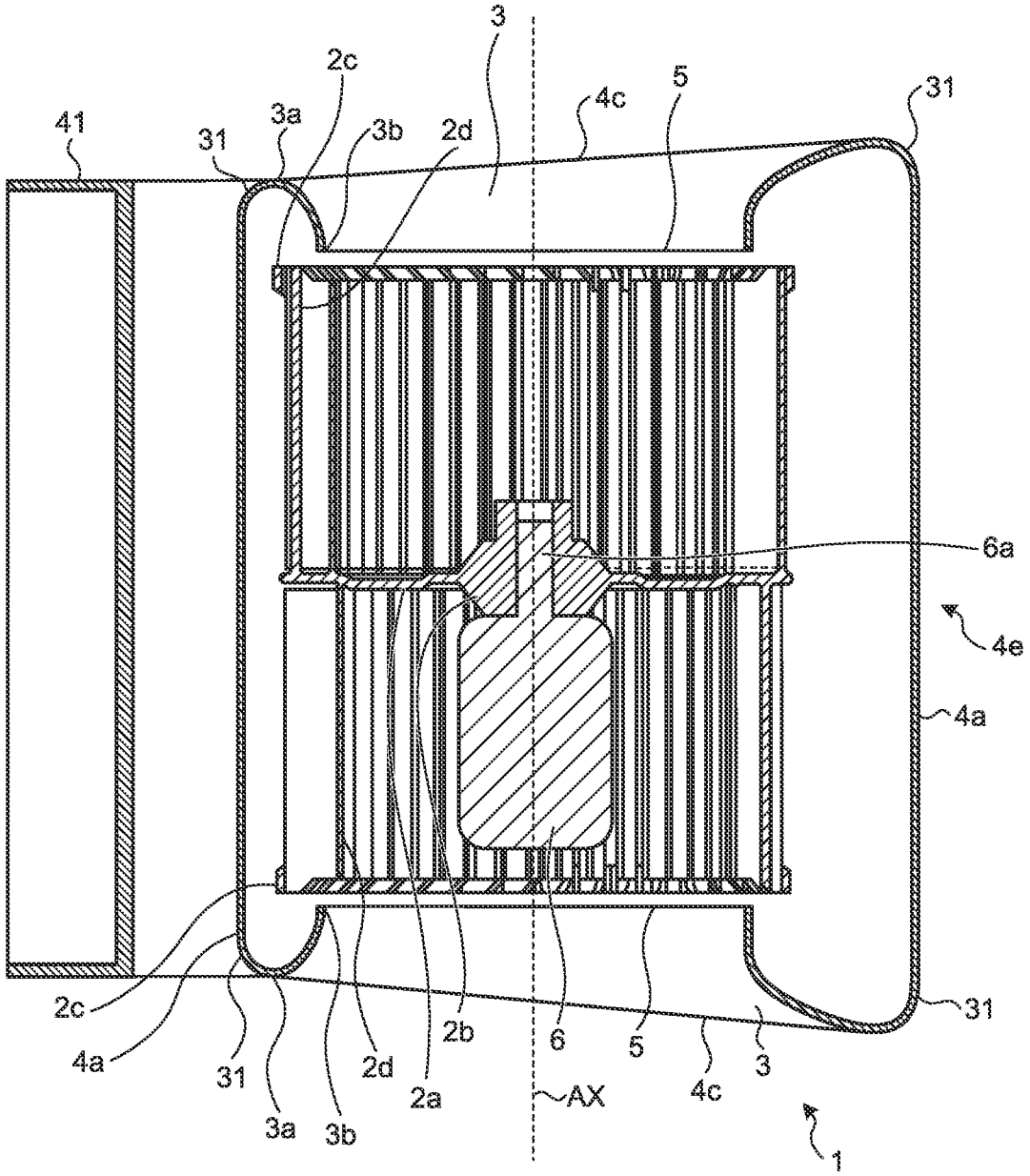
FIG. 20 is a cross-sectional view of an air blower according to a sixth embodiment of the present invention.

FIG. 20 is a cross-sectional view of an air blower according to a sixth embodiment of the present invention. In the air blower 1 according to the sixth embodiment, the position of the downstream end 3*b* of the bell mouth 3 in the axial direction of the rotation axis AX of the fan 2 remains constant, or unchanged. In the air blower 1 according to the sixth embodiment, the position of the upstream end 3*a* of the bell mouth 3 in the axial direction of the rotation axis AX of the fan 2 changes over the region from the end portion 41*a* to the end portion 41*b*. Therefore, as illustrated in FIG. 20, the upstream end 3*a* at a location where the angle θ relative to the end portion 41*a* is 180 degrees is located farther away from the main plate 2*a* than the upstream end 3*a* at the end portion 41*a*. The other aspects are the same as those of the air blower 1 according to the fifth embodiment.

As the air blower 1 according to the sixth embodiment can also reduce or prevent separation of the flow at the suction opening 5 in the axial direction, the air blower 1 according to the sixth embodiment can achieve a higher efficiency and reduce noise more effectively than the air blower 1 according to the first embodiment.

When the air blower 1 according to the sixth embodiment is housed in a case having a case suction opening oppositely to the discharge opening 41, the upstream end 3*a* of the bell mouth 3 is located far away from the main plate 2*a* on the side of the case suction opening. Accordingly, the curvature of the bell mouth 3 can be smaller. Thus, the air blower 1 according to the sixth embodiment can reduce separation of the airflow in the bell mouth 3, and enhance air blowing efficiency.

Seventh Embodiment

Figure 21:
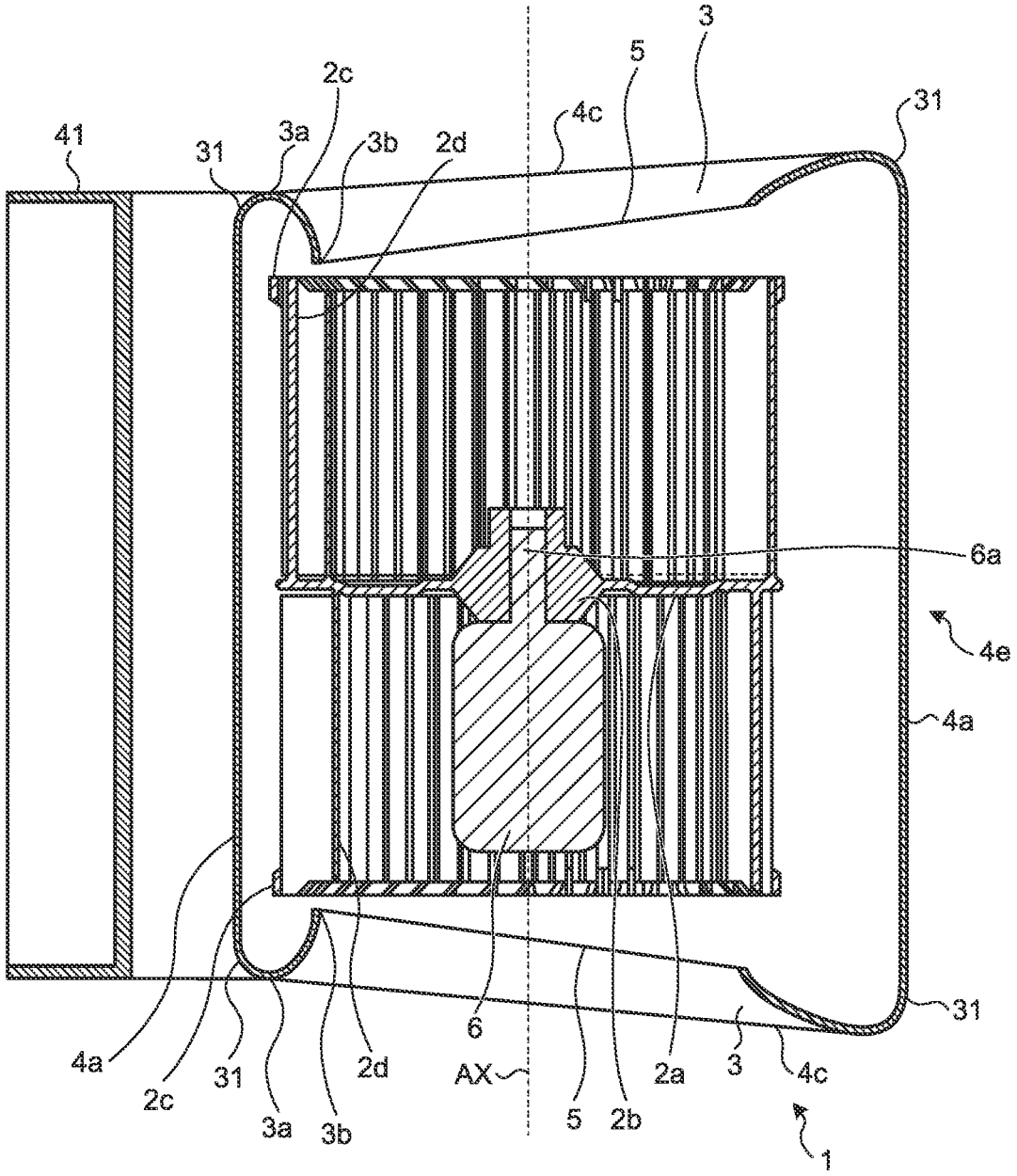
FIG. 21 is a cross-sectional view of an air blower according to a seventh embodiment of the present invention.

FIG. 21 is a cross-sectional view of an air blower according to a seventh embodiment of the present invention. In the air blower 1 according to the seventh embodiment, the position of the downstream end 3*b* of the bell mouth 3 in the axial direction of the rotation axis AX of the fan 2 changes over the region from the end portion 41*a* to the end portion 41*b*. Further, in the air blower 1 according to the seventh embodiment, the position of the upstream end 3*a* of the bell mouth 3 in the axial direction of the rotation axis AX of the fan 2 changes over the region from the end portion 41*a* to the end portion 41*b*. The upstream end 3*a* at a location where the angle θ relative to the end portion 41*a* is 180 degrees is located farther away from the main plate 2*a* than the upstream end 3*a* at the end portion 41*a*. The downstream end 3*b* at a location where the angle θ relative to the end portion 41*a* is 180 degrees is located farther away from the main plate 2*a* than the downstream end 3*b* at the end portion 41*a*. The other aspects are the same as those of the fifth embodiment.

When the air blower 1 according to the seventh embodiment is housed in a case having a case suction opening oppositely to the discharge opening 41, the upstream end 3*a* of the bell mouth 3 is located far away from the main plate 2*a* on the side of the case suction opening, as in the air blower 1 according to the sixth embodiment. Accordingly, the curvature of the bell mouth 3 can be smaller. Thus, the air blower 1 according to the seventh embodiment can reduce separation of the airflow in the bell mouth 3, and enhance air blowing efficiency.

Eighth Embodiment

Figure 22:
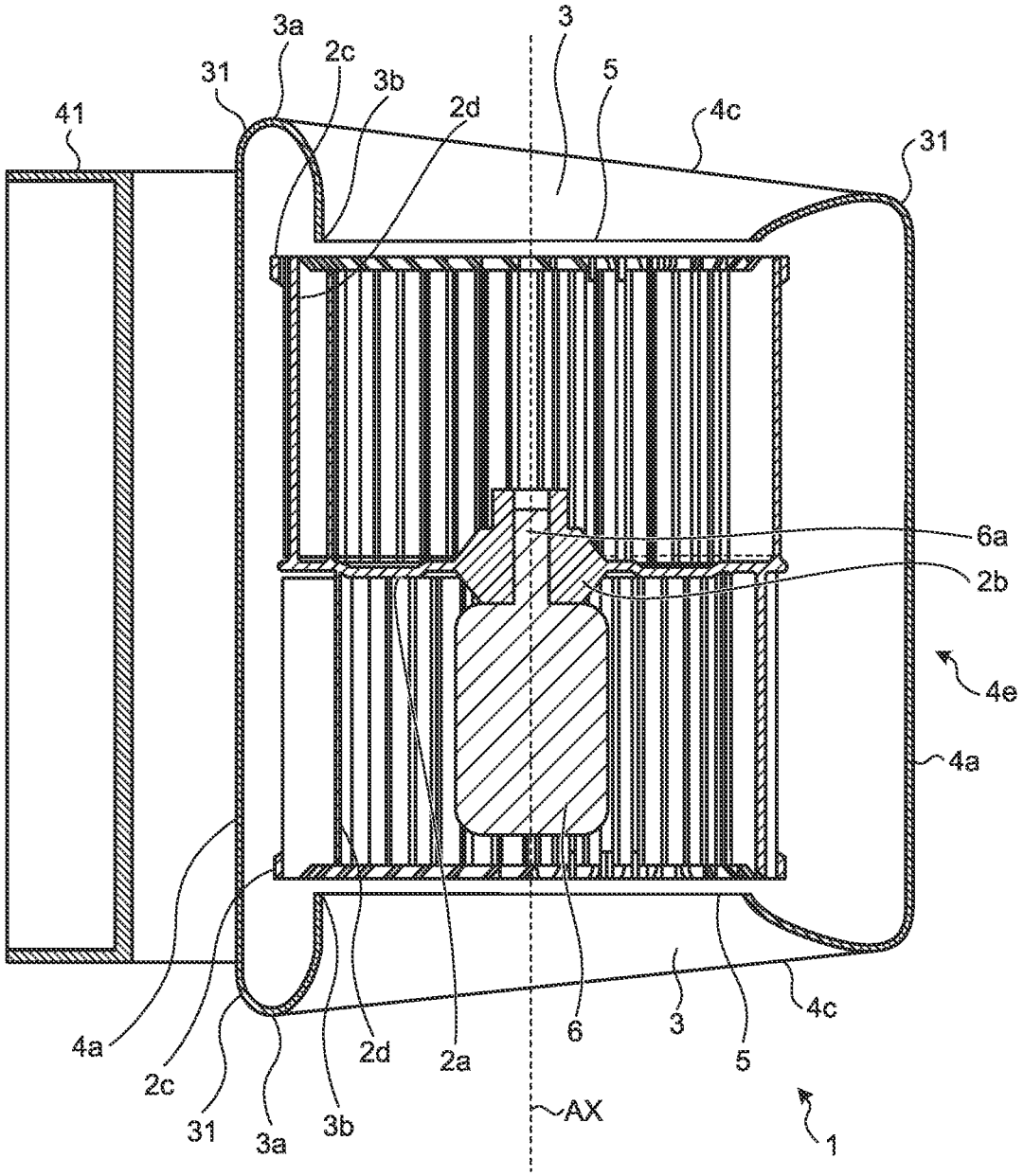
FIG. 22 is a cross-sectional view of an air blower according to an eighth embodiment of the present invention.

FIG. 22 is a cross-sectional view of an air blower according to an eighth embodiment of the present invention. In the air blower 1 according to the eighth embodiment, the position of the downstream end 3*b* of the bell mouth 3 in the axial direction of the rotation axis AX of the fan 2 remains constant, or unchanged. In the air blower 1 according to the eighth embodiment, the position of the upstream end 3*a* of the bell mouth 3 in the axial direction of the rotation axis AX of the fan 2 changes over the region from the end portion 41*a* to the end portion 41*b*. The upstream end 3*a* at a location where the angle θ relative to the end portion 41*a* is 180 degrees is located closer to the main plate 2*a* than the upstream end 3*a* at the end portion 41*a*. The other aspects are the same as those of the air blower 1 according to the first embodiment.

When the air blower 1 according to the eighth embodiment is housed in a case having a case suction opening oppositely to the discharge opening 41, the upstream end 3*a* of the bell mouth 3 is located close to the main plate 2*a* on the side of the case suction opening. Accordingly, a wide airflow path can be secured between the air blower 1 and the case housing the air blower 1. Thus, the air blower 1 according to the eighth embodiment can enhance air blowing efficiency. Further, in the air blower 1 according to the eighth embodiment, the upstream end 3*a* of the bell mouth 3 is located far away from the main plate 2*a* on the side of the discharge opening 41 and the end portion 41*a*, and the curvature in the axial direction of the bell mouth 3 is smaller. As a result, the noise increase due to standing waves can be reduced.

Ninth Embodiment

Figure 23:
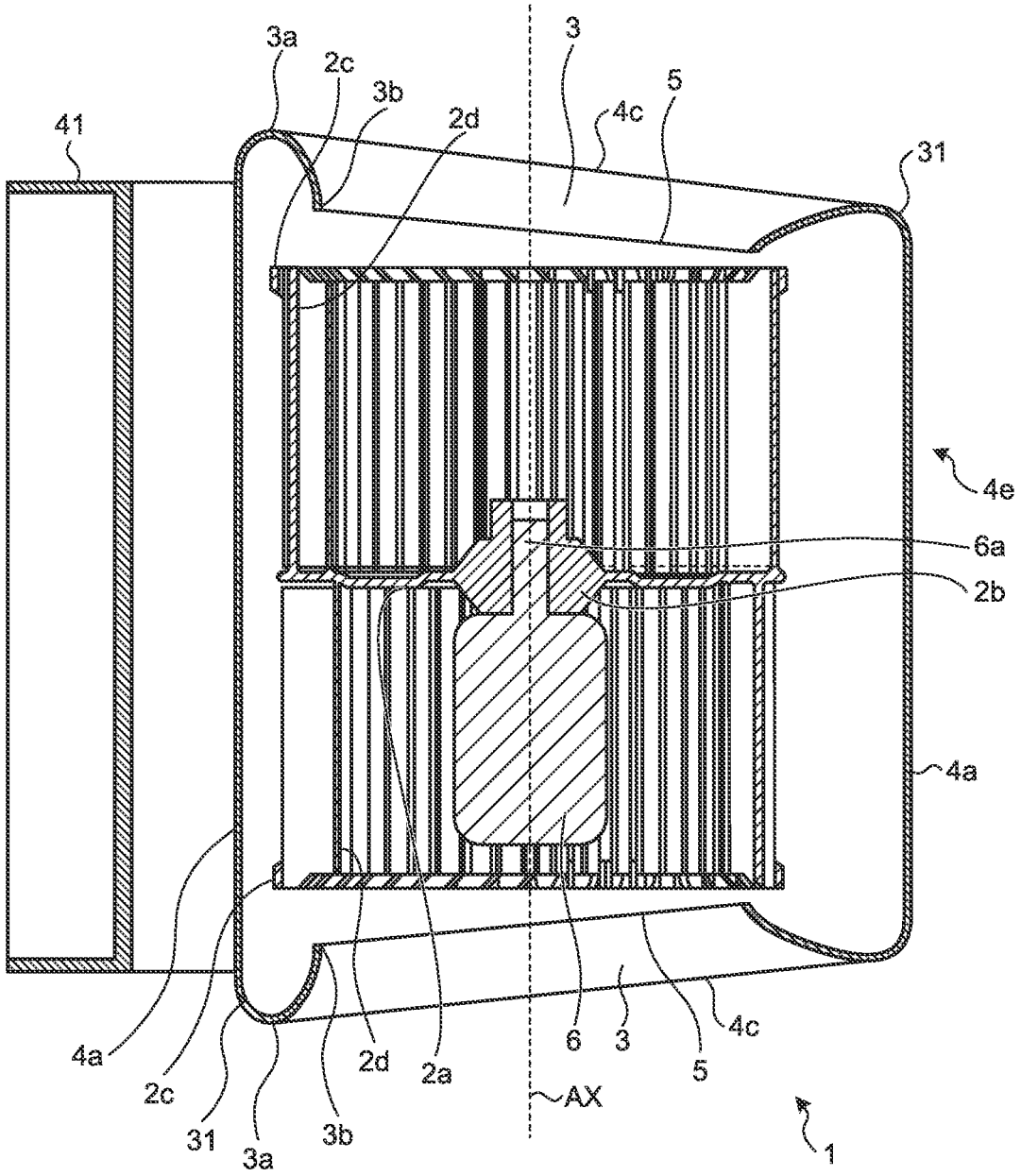
FIG. 23 is a cross-sectional view of an air blower according to a ninth embodiment of the present invention.

FIG. 23 is a cross-sectional view of an air blower according to a ninth embodiment of the present invention. In the air blower 1 according to the ninth embodiment, the position of the downstream end 3*b* of the bell mouth 3 in the axial direction of the rotation axis AX of the fan 2 changes over the region from the end portion 41*a* to the end portion 41*b*. Further, in the air blower 1 according to the ninth embodiment, the position of the upstream end 3*a* of the bell mouth 3 in the axial direction of the rotation axis AX of the fan 2 changes over the region from the end portion 41*a* to the end portion 41*b*. The upstream end 3*a* at a location where the angle θ relative to the end portion 41*a* is 180 degrees is located closer to the main plate 2*a* than the upstream end 3*a* at the end portion 41*a*. The downstream end 3*b* at a location where the angle θ relative to the end portion 41*a* is 180 degrees is located closer to the main plate 2*a* than the downstream end 3*b* at the end portion 41*a*. The other aspects are the same as those of the air blower 1 according to the first embodiment.

When the air blower 1 according to the ninth embodiment is housed in a case having a case suction opening oppositely to the discharge opening 41, the upstream end 3*a* of the bell mouth 3 is located close to the main plate 2*a* on the side of the case suction opening. Accordingly, a wide airflow path can be secured between the air blower 1 and the case housing the air blower 1. Thus, the air blower 1 according to the ninth embodiment can enhance air blowing efficiency.

Tenth Embodiment

Figure 24:
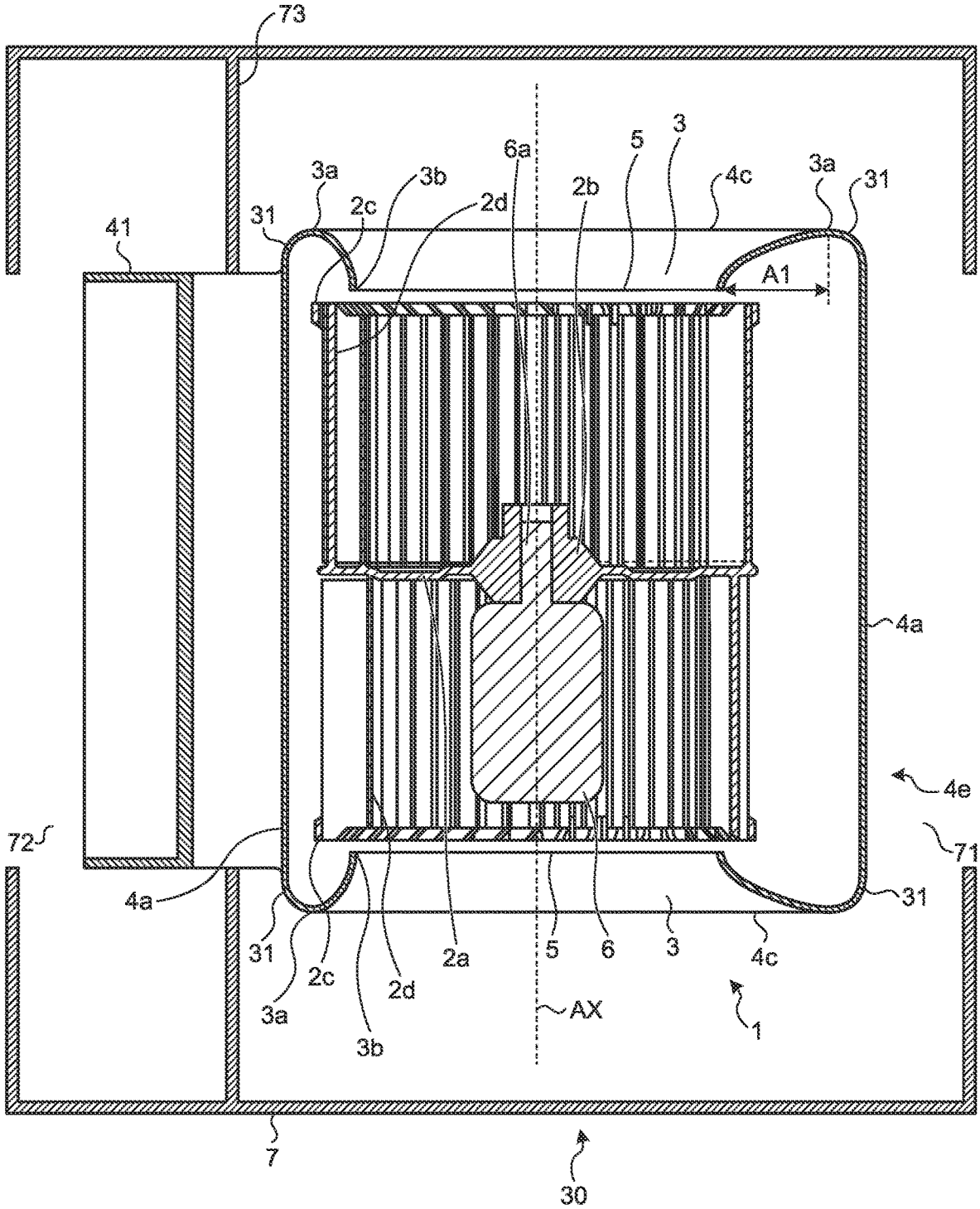
FIG. 24 is a diagram illustrating the configuration of an air-blowing apparatus according to a tenth embodiment of the present invention.

FIG. 24 is a diagram illustrating the configuration of an air-blowing apparatus according to a tenth embodiment of the present invention. An air-blowing apparatus 30 according to the tenth embodiment includes the air blower 1 according to the first embodiment, and a case 7 that houses the air blower 1. The case 7 is has two openings: a case suction opening 71 and a case discharge opening 72. The case 7 has a partition plate 73. The partition plate 73 separates a part having the case suction opening 71 formed therein, from a part having the case discharge opening 72 formed therein. The air blower 1 is installed such that the suction opening 5 is located in a space on the side having the case suction opening 71 formed therein, and the discharge opening 41 is located in a space on the side having the case discharge opening 72 formed therein. The bell mouth 3 has a portion providing the longest radial distance A1 between the upstream end 3*a* and the downstream end 3*b* in the entire circumference of the bell mouth 3. The air blower 1 is installed such that the portion providing the longest radial distance A1 is located on the side of the case suction opening 71. Specifically, the portion providing the longest radial distance A1 between the upstream end 3*a* and the downstream end 3*b* is located between the case suction opening 71 and the rotation axis AX of the fan 2 in the radial direction. More preferably, the portion providing the longest radial distance A1 between the upstream end 3*a* and the downstream end 3*b* is located with the upstream end 3*a* being closest to the case suction opening 71.

The air-blowing apparatus 30 according to the tenth embodiment includes the air blower 1 in which the radial distance between the upstream end 3*a* and the downstream end 3*b* of the bell mouth 3 becomes longer in the direction of rotation of the fan 2 than the distance in the radial direction at the end portion 41*a* of the discharge opening 41. Thus, a higher air blowing efficiency can be achieved, and noise can be reduced. Further, since the portion providing the longest radial distance A1 between the upstream end 3*a* and the downstream end 3*b* is disposed on the side of the case suction opening 71, the fast airflow entering from the case suction opening 71 can be smoothly guided along the bell mouth 3. Accordingly, separation of the airflow from the bell mouth 3 can be reduced. Thus, air blowing efficiency can be enhanced, and noise can be reduced. Note that the same effects as above can be achieved in a case where the air-blowing apparatus includes an air blower 1 according to one of the second through ninth embodiments.

Eleventh Embodiment

Figure 25:
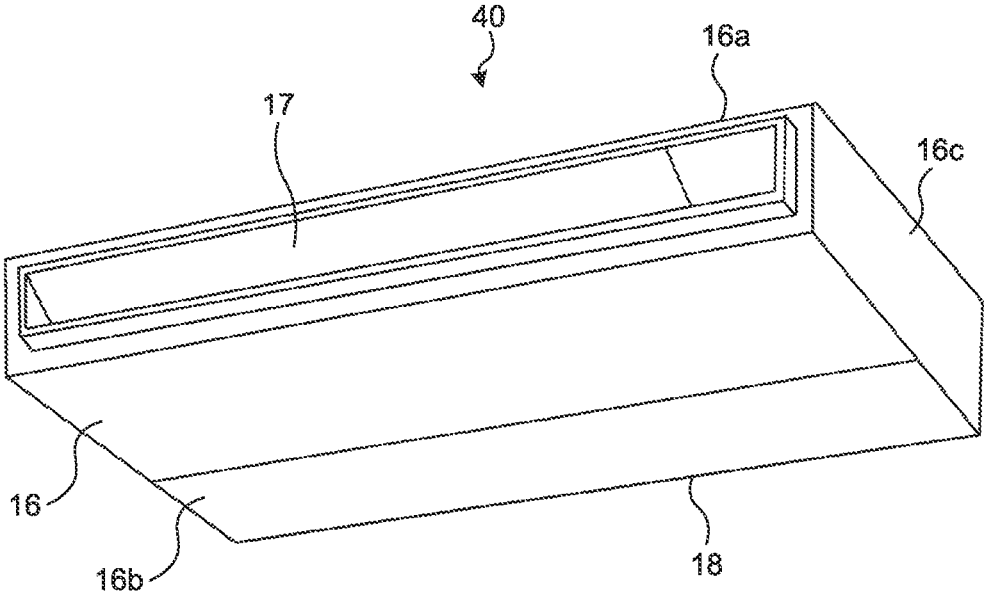
FIG. 25 is a perspective view of an air-conditioning apparatus according to an eleventh embodiment of the present invention.
Figure 26:
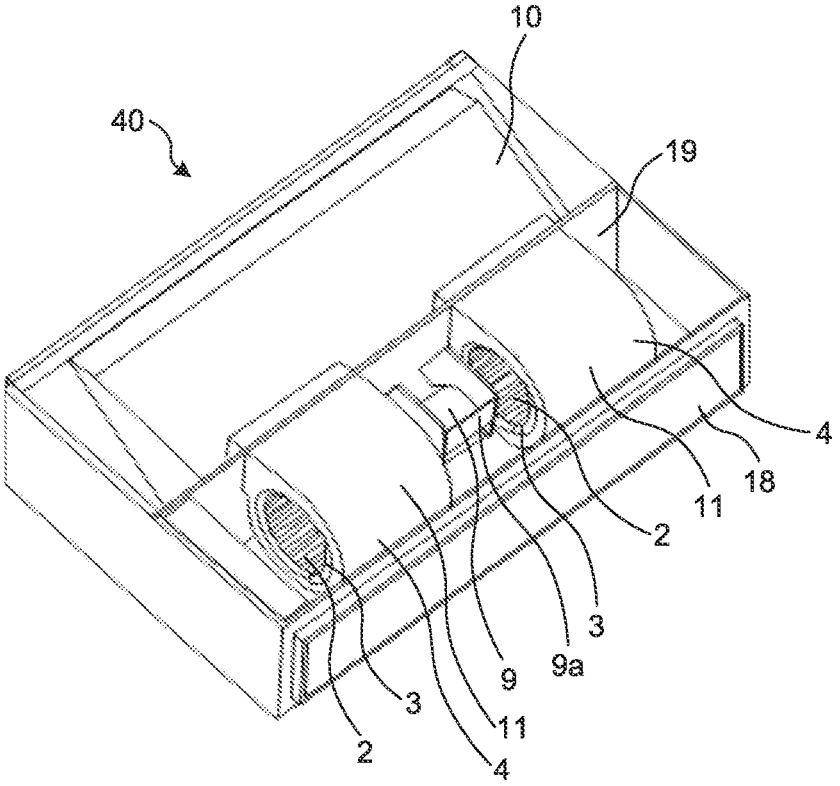
FIG. 26 is a diagram illustrating the internal configuration of the air-conditioning apparatus according to the eleventh embodiment.
Figure 27:
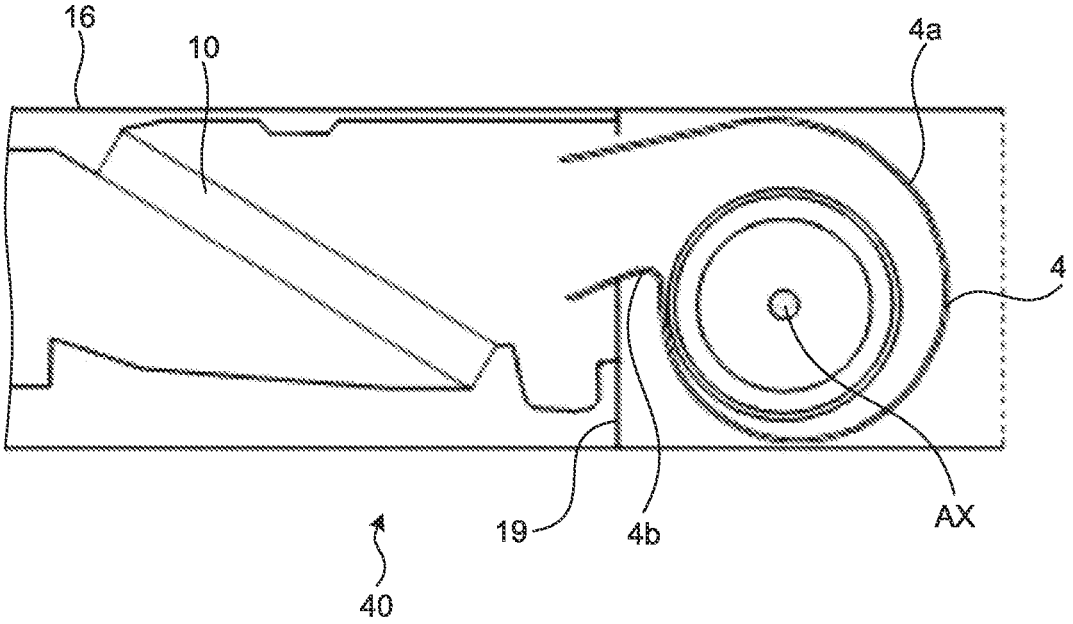
FIG. 27 is a cross-sectional view of the air-conditioning apparatus according to the eleventh embodiment.

FIG. 25 is a perspective view of an air-conditioning apparatus according to an eleventh embodiment of the present invention. FIG. 26 is a diagram illustrating the internal configuration of the air-conditioning apparatus according to the eleventh embodiment. FIG. 27 is a cross-sectional view of the air-conditioning apparatus according to the eleventh embodiment. An air-conditioning apparatus according to the eleventh embodiment includes a case 16 installed in the ceiling of the room to be air-conditioned. In the eleventh embodiment, the case 16 is in the shape of a rectangular parallelepiped including an upper surface portion 16*a*, a lower surface portion 16*b*, and side surface portions 16*c*. Note that the shape of the case 16 is not necessarily the shape of a rectangular parallelepiped.

A case discharge opening 17 is formed in one of the side surface portions 16*c* of the case 16. The shape of the case discharge opening 17 is not limited to any particular shape. The shape of the case discharge opening 17 may be rectangular, for example. Of the side surface portions 16*c* of the case 16, a surface opposite to the surface having the case discharge opening 17 formed therein has a case suction opening 18 formed therein. The shape of the case suction opening 18 is not limited to any particular shape. The shape of the case suction opening 18 may be rectangular, for example. A filter for removing dust in the air may also be disposed in the case suction opening 18.

The case 16 houses two air blowers 11, a fan motor 9, and a heat exchanger 10. The air blowers 11 each include a scroll casing 4 defining a bell mouth 3 and a fan 2. Each air blower 11 has the same fan 2 and the same scroll casing 4 as those of the air blower 1 according to the first embodiment, but differs from the air blower 1 in that the fan motor 6 is not disposed in the scroll casing 4. Accordingly, the shape of the bell mouth 3 of each air blower 11 is the same as that of the first embodiment. The fan motor 9 is supported by a motor support 9*a* secured to the upper surface portion 16*a* of the case 16. The fan motor 9 has a rotation axis AX. The two surfaces among the side surface portions 16*c* have the case discharge opening 17 and the case suction opening 18 formed therein respectively, and the rotation axis AX is positioned extending in parallel to these two surfaces. In the air-conditioning apparatus 40 illustrated in FIG. 25, two fans 2 are attached to the rotation axis AX. Each fan 2 forms a flow of air that is sucked into the case 16 through the case suction opening 18 and is blown out from the case discharge opening 17 to the space to be air-conditioned. Note that the number of the fans 2 attached to the fan motor 9 is not necessarily two.

The heat exchanger 10 is disposed in the airflow path. The heat exchanger 10 adjusts the temperature of the air. Note that a heat exchange having a known structure may be used as the heat exchanger 10.

The space on the suction side of the scroll casing 4 and the space on the discharge side are separated by a partition plate 19.

When the fans 2 rotate, the air in the room to be air-conditioned is sucked into the case 16 through the case suction opening 18. The air sucked into the case 16 is guided to the bell mouths 3 and is sucked into the fans 2. The air sucked into the fans 2 is blown radially outward. The air blown out of the fans 2 passes through the inside of the scroll casing 4, is blown out from the discharge opening 41 of each scroll casing 4, and is supplied to the heat exchanger 10. The air supplied to the heat exchanger is subjected to heat exchange and humidity adjustment, while passing through the heat exchanger 10. The air that has passed through the heat exchanger 10 is blown out from the case discharge opening 17 into the room.

In the air-conditioning apparatus 40 according to the eleventh embodiment, the airflow sucked into the air blowers 11 is unlikely to be separated from the bell mouth 3. Thus, air blowing efficiency can be enhanced, and noise can be reduced.

Note that, in the above description, the shape of the bell mouth 3 of each air blower 11 is the same as that of the air blower 1 according to the first embodiment. However, the shape of the bell mouth 3 of each air blower 11 may be the same as the shape of the bell mouth 3 of the air blower 1 according to one of the second through ninth embodiments. Also, each air blower 11 may be installed such that a portion of the bell mouth 3 providing the longest radial distance A1 between the upstream end 3*a* and the downstream end 3*b* of the bell mouth 3 in the entire circumference of the bell mouth 3 is located on the side of the case suction opening 18, as in the air-blowing apparatus 30 according to the tenth embodiment.

Twelfth Embodiment

Figure 28:
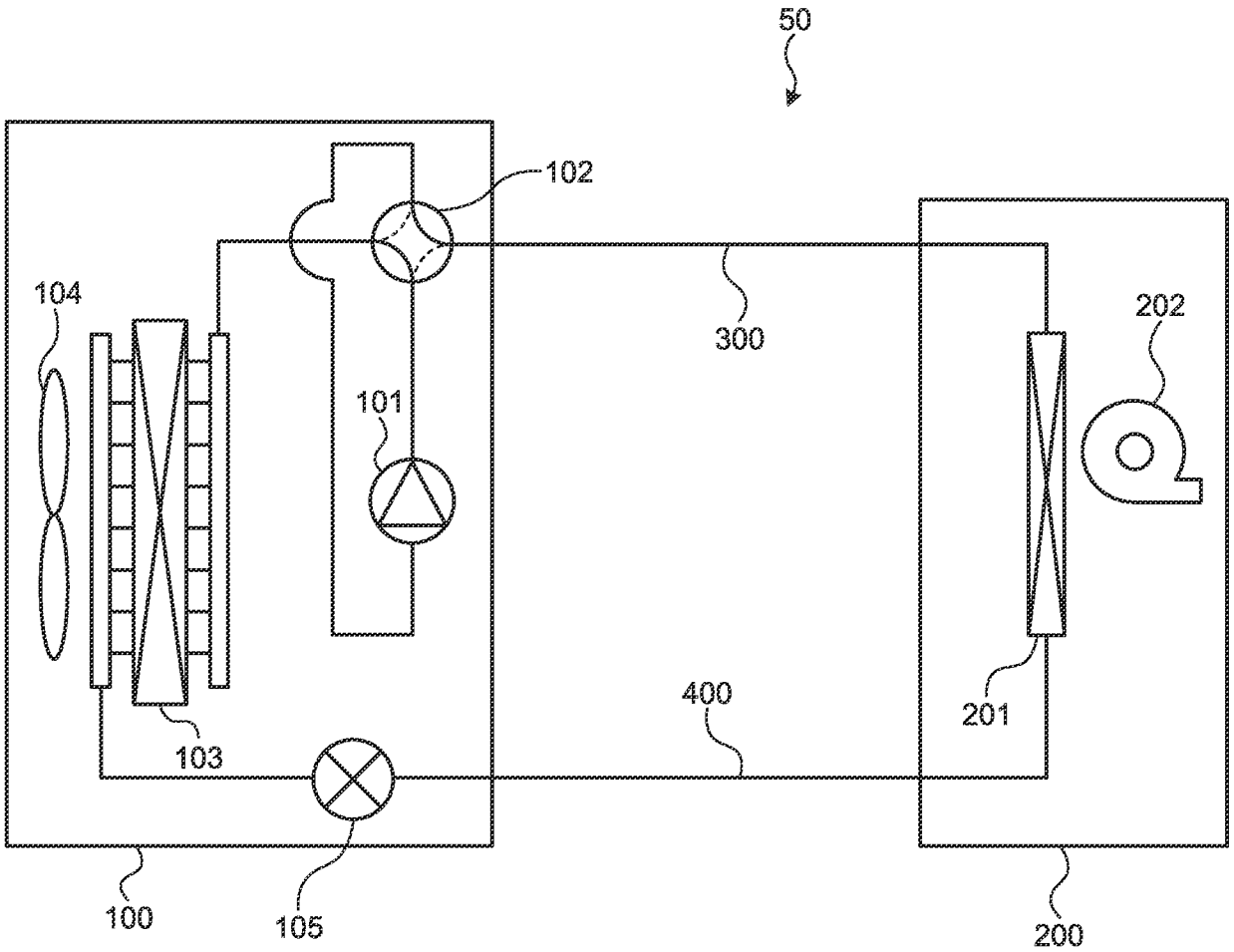
FIG. 28 is a diagram illustrating the configuration of a refrigeration cycle apparatus according to a twelfth embodiment of the present invention.

FIG. 28 is a diagram illustrating the configuration of a refrigeration cycle apparatus according to a twelfth embodiment of the present invention. In a refrigeration cycle apparatus 50 according to the twelfth embodiment, an outdoor unit 100 and an indoor unit 200 are connected by refrigerant pipes, to form a refrigerant circuit in which a refrigerant circulates. Of the refrigerant pipes, the pipe in which a gas-phase refrigerant flows is a gas pipe 300, and the pipe in which a liquid-phase refrigerant flows is a liquid pipe 400. Note that a gas-liquid two-phase refrigerant may flow in the liquid pipe 400.

The outdoor unit 100 includes a compressor 101, a four-way valve 102, an outdoor heat exchanger 103, an outdoor air blower 104, and a throttle device 105.

The compressor 101 compresses a sucked refrigerant, and discharges the compressed refrigerant. Here, the compressor 101 includes an inverter device, and it is possible to change the capacity of the compressor 101 by changing the operation frequency. Note that the capacity of the compressor 101 is the amount of the refrigerant to be sent out per unit time. The four-way valve 102 switches the flow of the refrigerant between a cooling operation and a heating operation, in accordance with an instruction from a control device (not shown).

The outdoor heat exchanger 103 conducts heat exchange between the refrigerant and the outdoor air. The outdoor heat exchanger 103 functions as an evaporator during a heating operation, and conducts heat exchange between the outdoor air and the low-pressure refrigerant having entered through the liquid pipe 400, to evaporate and vaporize the refrigerant. The outdoor heat exchanger 103 functions as a condenser during a cooling operation, and conducts heat exchange between the outdoor air and the refrigerant that has entered from the side of the four-way valve 102 and been compressed by the compressor 101, to condense and liquefy the refrigerant.

The outdoor heat exchanger 103 is provided with the outdoor air blower 104, to enhance the efficiency of heat exchange between the refrigerant and the outdoor air. The outdoor air blower 104 may change the operation frequency of the fan motor 6 with the inverter device, to change the rotation speed of the fan 2. The throttle device 105 changes the size of the opening, to adjust the pressure of the refrigerant.

The indoor unit 200 includes a load heat exchanger 201 that conducts heat exchange between the refrigerant and the indoor air, and a load air blower 202 that adjusts the flow of the air in which the load heat exchanger 201 conducts heat exchange. The load heat exchanger 201 functions as a condenser during a heating operation, conducts heat exchange between the indoor air and the refrigerant having entered through the gas pipe 300, condenses and liquefies the refrigerant, and lets the refrigerant flow out to the liquid pipe 400. The load heat exchanger 201 functions as an evaporator during a cooling operation, conducts heat exchange between the indoor air and the refrigerant put into a low-pressure state by the throttle device 105, lets the refrigerant remove heat from the air to evaporate and liquefy the refrigerant, and lets the refrigerant flow out to the gas pipe 300. The operation speed of the load air blower 202 is determined by a user setting.

The refrigeration cycle apparatus 50 according to the twelfth embodiment moves heat between outdoor air and indoor air via a refrigerant, and thus, heats or cools a room to perform air conditioning.

In the refrigeration cycle apparatus 50 according to the twelfth embodiment, an air blower 1 according to one of the first through ninth embodiments is used as the outdoor air blower 104, to reduce air volume and noise.

Note that the load air blower 202 of the indoor unit 200 may include a bell mouth 3 having the same shape as that of an air blower 1 according to one of the first through ninth embodiments.

The configurations described in the above embodiments are examples of the subject matter of the present invention, and can be combined with other known techniques, or may be partially omitted or modified without departing from the scope of the present invention.

REFERENCE SIGNS LIST

1, 11 air blower; 2 fan; 2*a* main plate; 2*b* boss portion; 2*c* side plate; 2*d* blade; 3 bell mouth; 3*a* upstream end; 3*b* downstream end; 4 scroll casing; 4*a* peripheral wall; 4*b* tongue portion; 4*c* sidewall; 4*e* scroll portion; 5 suction opening; 6, 9 fan motor; 6*a* output shaft; 7, 16 case; 9*a* motor support; 10 heat exchanger; 16*a* upper surface portion; 16*b* lower surface portion; 16*c* side surface portion; 17, 72 case discharge opening; 18, 71 case suction opening; 19, 73 partition plate; 30 air-blowing apparatus; 31 curved portion; 40 air-conditioning apparatus; 41 discharge opening; 41*a*, 41*b* end portion; 42 step; 43 connecting portion; 44 engaging portion; 45 flat surface portion; 46 curved surface portion; 50 refrigeration cycle apparatus; 100 outdoor unit; 101 compressor; 102 four-way valve; 103 outdoor heat exchanger; 104 outdoor air blower; 105 throttle device; 200 indoor unit; 201 load heat exchanger; 202 load air blower; 300 gas pipe; 400 liquid pipe.

The invention claimed is:

1. A centrifugal air blower comprising:

a fan including a disk-shaped main plate and a plurality of blades disposed on a peripheral portion of the main plate; and a scroll casing including:

a sidewall covering the fan from an axial direction of a rotation axis on which the fan rotates, the sidewall having a suction opening for sucking air;

a discharge opening for discharging an airflow generated by the fan;

a tongue portion for guiding the airflow to the discharge opening;

a peripheral wall surrounding the fan from a radial direction of the rotation axis, the peripheral wall extending in a direction of rotation of the fan from a first end portion of the discharge opening located on a side of the tongue portion to a second end portion of the discharge opening located away from the tongue portion; and a bell mouth formed along the suction opening of the sidewall, wherein the bell mouth includes an upstream end and a downstream end, the upstream end being an end portion on an upstream side in a direction of flow of the air passing through the suction opening, the downstream end being an end portion on a downstream side in the direction of flow of the air, the upstream end of the bell mouth and the sidewall of the scroll casing are connected to each other by a connecting portion, a distance in the radial direction of the rotation axis between the upstream end and the downstream end of the bell mouth is longer at a location where an angle relative to the first end portion of the discharge opening in the direction of rotation of the fan is larger, between the first end portion and the second end portion of the discharge opening, a position of the upstream end in the axial direction of the rotation axis remains constant, the scroll casing includes a curling start portion, a curling end portion, and an opposite portion to the tongue portion, the curling start portion is a portion at which the angle relative to the first end portion of the discharge opening in the direction of rotation of the fan is larger than 0 degrees but is smaller than 120 degrees, the curling end portion is a portion at which the angle relative to the first end portion of the discharge opening in the direction of rotation of the fan is larger than 240 degrees but is smaller than 360 degrees, and the opposite portion is a portion at which the angle relative to the first end portion of the discharge opening in the direction of rotation of the fan is larger than 120 degrees but is smaller than 240 degrees, the bell mouth has a flat surface portion at at least one of the curling start portion, the curling end portion, and the opposite portion to the tongue portion, and at the flat surface portion, the bell mouth has a linear outer contour when viewed from the axial direction of the rotation axis.

2. The centrifugal air blower according to claim 1, wherein a distance in the axial direction of the rotation axis between the upstream end and the downstream end of the bell mouth is longer than a distance in a radial direction perpendicular to the rotation axis between the upstream end and the downstream end of the bell mouth.

3. The centrifugal air blower according to claim 1, wherein the scroll casing includes a scroll portion defined by the sidewall and the peripheral wall, and a step formed at a boundary between the discharge opening and the scroll portion such that the airflow is reduced in the cross-sectional area as the airflow travels from the scroll portion toward the discharge opening.

4. The centrifugal air blower according to claim 1, wherein the scroll casing is defined by a plurality of components joined together at a plurality of locations, and, at least one of engaging portions by which the components are engaged with one another is disposed at a plane perpendicular to the rotation axis that is closer to the main plate of the fan than the upstream end of the bell mouth in the axial direction of the rotation axis and disposed on the sidewall between the upstream end of the bell mouth and the peripheral wall of the scroll casing.

5. An air-blowing apparatus comprising:

a case housing the centrifugal air blower according to claim 1, wherein the case includes:

a case suction opening communicating with the suction opening of the centrifugal air blower;

a case discharge opening communicating with the discharge opening of the centrifugal air blower; and a partition plate separating a part having the case suction opening formed therein, from a part having the case discharge opening formed therein.

6. The air blowing apparatus according to claim 5, wherein a portion at which a distance in the radial direction of the rotation axis between the upstream end and the downstream end of the bell mouth is longest in an entire circumference of the bell mouth is located on a side of the case suction opening.

7. An air-conditioning apparatus comprising the air-blowing apparatus according to claim 5, wherein the case includes a heat exchanger in the part having the case discharge opening formed therein.

8. A refrigeration cycle apparatus comprising the centrifugal air blower according to claim 1.

* * * * *